US009904195B2

(12) United States Patent
Matsui et al.

(10) Patent No.: US 9,904,195 B2
(45) Date of Patent: Feb. 27, 2018

(54) TONER, IMAGE FORMING APPARATUS, AND IMAGE FORMING METHOD

(71) Applicant: CANON KABUSHIKI KAISHA, Tokyo (JP)

(72) Inventors: Takashi Matsui, Mishima (JP); Naoki Okamoto, Mishima (JP); Satoshi Arimura, Toride (JP); Keisuke Tanaka, Yokohama (JP); Shohei Tsuda, Suntou-gun (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 15/416,055

(22) Filed: Jan. 26, 2017

(65) Prior Publication Data

US 2017/0219945 A1 Aug. 3, 2017

(30) Foreign Application Priority Data

Jan. 28, 2016 (JP) ..... 2016-014520

(51) Int. Cl.
*G03G 9/097* (2006.01)
*G03G 9/09* (2006.01)
(Continued)

(52) U.S. Cl.
CPC ..... *G03G 9/09* (2013.01); *G03G 9/083* (2013.01); *G03G 9/087* (2013.01); *G03G 15/08* (2013.01)

(58) Field of Classification Search
CPC ..... G03G 9/09725
See application file for complete search history.

(56) References Cited

U.S. PATENT DOCUMENTS 4,657,838 A 4/1987 Fukumoto et al.
4,673,631 A 6/1987 Fukumoto et al.
(Continued)

FOREIGN PATENT DOCUMENTS

JP H06301236 A 10/1994
JP 2005173484 A 6/2005
(Continued)

OTHER PUBLICATIONS

U.S. Appl. No. 15/361,583, Yuujirou Nagashima, filed Nov. 28, 2016.
(Continued)

*Primary Examiner* — Hoa V Le
(74) *Attorney, Agent, or Firm* — Fitzpatrick Cella Harper and Scinto

(57) ABSTRACT

A toner comprising: a toner particle containing a binder resin and a colorant, and an inorganic fine particle A and B present on the surface of the toner particle, wherein the inorganic fine particle A is a silica fine particle having a number-average particle diameter (D1) of primary particles in a specific range, the inorganic fine particle B has a number-average particle diameter (D1) of primary particles in a specific range, and is at least one fine particle selected from a group consisting of a silica fine particle, a titanium oxide fine particle, and an alumina fine particle, A total fixing ratio of the inorganic fine particle A and B is 75% or more, and an inter-particle force Fp(A) and an inter-particle force Fp(B) are within specific numerical ranges and satisfy a specific relationship.

7 Claims, 13 Drawing Sheets

(51) Int. Cl.

| | |
|---|---|
| ***G03G 9/083*** | (2006.01) |
| ***G03G 9/087*** | (2006.01) |
| ***G03G 15/08*** | (2006.01) |

(56) References Cited

U.S. PATENT DOCUMENTS

| | | | | |
|---|---|---|---|---|
| 4,710,443 | A | 12/1987 | Tanaka et al. | |
| 4,737,432 | A | 4/1988 | Tanaka et al. | |
| 4,839,255 | A | 6/1989 | Hyosu et al. | |
| 4,886,725 | A | 12/1989 | Tanaka et al. | |
| 5,071,727 | A | 12/1991 | Ikeda et al. | |
| 5,288,579 | A | 2/1994 | Tanaka et al. | |
| 5,306,588 | A | 4/1994 | Tanaka et al. | |
| 5,356,749 | A | 10/1994 | Hagiwara et al. | |
| 5,508,139 | A | 4/1996 | Tanaka et al. | |
| 7,239,831 | B2 | 7/2007 | Hagiwara et al. | |
| 7,361,400 | B2 | 4/2008 | Shimamura et al. | |
| 7,396,626 | B2 | 7/2008 | Fujikawa et al. | |
| 7,396,629 | B2 | 7/2008 | Baba et al. | |
| 7,611,813 | B2 | 11/2009 | Ida et al. | |
| 7,629,100 | B2 | 12/2009 | Okamoto et al. | |
| 7,678,523 | B2 | 3/2010 | Hiroko et al. | |
| 7,767,370 | B2 | 8/2010 | Ishigami et al. | |
| 7,842,446 | B2 | 11/2010 | Yanase et al. | |
| 7,923,190 | B2 | 4/2011 | Magome et al. | |
| 7,935,467 | B2 | 5/2011 | Dojo et al. | |
| 8,114,562 | B2 | 2/2012 | Ishigami et al. | |
| 8,298,742 | B2 | 10/2012 | Okamoto et al. | |
| 8,343,702 | B2 * | 1/2013 | Kim | G03G 9/081 430/109.1 |
| 8,426,091 | B2 | 4/2013 | Magome et al. | |
| 8,426,094 | B2 | 4/2013 | Magome et al. | |
| 8,455,169 | B2 | 6/2013 | Inoue et al. | |
| 8,614,044 | B2 | 12/2013 | Matsui et al. | |
| 8,673,530 | B2 | 3/2014 | Yang et al. | |
| 8,703,378 | B2 | 4/2014 | Satoh et al. | |
| 8,778,585 | B2 | 7/2014 | Matsui et al. | |
| 8,841,054 | B2 | 9/2014 | Dojo et al. | |
| 8,883,389 | B2 | 11/2014 | Matsui et al. | |
| 8,945,805 | B2 | 2/2015 | Baba et al. | |
| 9,005,865 | B2 | 4/2015 | Ikeda et al. | |
| 9,034,551 | B2 | 5/2015 | Endo et al. | |
| 9,046,800 | B2 | 6/2015 | Hotta et al. | |
| 9,097,997 | B2 | 8/2015 | Nomura et al. | |
| 9,213,250 | B2 | 12/2015 | Nomura et al. | |
| 9,213,251 | B2 | 12/2015 | Ohmori et al. | |
| 9,217,943 | B2 | 12/2015 | Matsui et al. | |
| 9,235,151 | B2 | 1/2016 | Tanaka et al. | |
| 9,239,528 | B2 | 1/2016 | Hasegawa et al. | |
| 9,261,806 | B2 | 2/2016 | Moribe et al. | |
| 9,285,697 | B2 | 3/2016 | Fukudome et al. | |
| 9,304,422 | B2 | 4/2016 | Matsui et al. | |
| 9,348,246 | B2 | 5/2016 | Magome et al. | |
| 9,354,545 | B2 | 5/2016 | Matsui et al. | |
| 9,442,416 | B2 | 9/2016 | Magome et al. | |
| 9,442,419 | B2 | 9/2016 | Wakabayashi et al. | |
| 9,470,993 | B2 | 10/2016 | Nishikawa et al. | |
| 9,575,425 | B2 | 2/2017 | Naka et al. | |
| 9,581,934 | B2 | 2/2017 | Ito et al. | |
| 2002/0061457 | A1 * | 5/2002 | Okuno | G03G 9/0819 430/108.6 |
| 2004/0043316 | A1 * | 3/2004 | Miho | G03G 9/097 430/108.6 |
| 2004/0170913 | A1 * | 9/2004 | Lee | G03G 9/08 430/108.6 |
| 2004/0229145 | A1 * | 11/2004 | Lee | G03G 9/08755 430/108.6 |
| 2006/0040195 | A1 * | 2/2006 | Miyakawa | G03G 9/0821 430/108.7 |
| 2006/0067741 | A1 * | 3/2006 | Azami | G03G 15/0907 399/267 |
| 2008/0160441 | A1 * | 7/2008 | Kim | G03G 9/09321 430/109.3 |
| 2008/0160442 | A1 * | 7/2008 | Kim | G03G 9/08782 430/109.3 |
| 2009/0023087 | A1 * | 1/2009 | Kim | G03G 9/081 430/109.3 |
| 2009/0068582 | A1 * | 3/2009 | Kawaguchi | G03G 9/081 430/109.4 |
| 2009/0197192 | A1 | 8/2009 | Hiroko et al. | |
| 2010/0040968 | A1 * | 2/2010 | Bejat | G03G 9/08711 430/108.6 |
| 2010/0040969 | A1 * | 2/2010 | Bejat | G03G 9/0819 430/111.1 |
| 2013/0196265 | A1 * | 8/2013 | Kamae | G03G 9/1075 430/111.35 |
| 2015/0125790 | A1 | 5/2015 | Hotta et al. | |
| 2015/0185646 | A1 * | 7/2015 | Srinivasan | G03G 9/08711 430/137.21 |
| 2015/0185647 | A1 * | 7/2015 | Srinivasan | G03G 9/08711 430/108.3 |
| 2015/0185658 | A1 | 7/2015 | Wakabayashi et al. | |
| 2015/0227067 | A1 | 8/2015 | Hasegawa et al. | |
| 2015/0227068 | A1 | 8/2015 | Sano et al. | |
| 2015/0301464 | A1 * | 10/2015 | Peter | G03G 9/08711 430/109.3 |
| 2016/0041481 | A1 | 2/2016 | Nomura et al. | |
| 2016/0041482 | A1 | 2/2016 | Terauchi et al. | |
| 2016/0041484 | A1 | 2/2016 | Tsuda et al. | |
| 2016/0070192 | A1 | 3/2016 | Terauchi et al. | |
| 2016/0091809 | A1 | 3/2016 | Tsuda et al. | |
| 2016/0139521 | A1 | 5/2016 | Tsuda et al. | |
| 2016/0154331 | A1 | 6/2016 | Tanaka et al. | |
| 2016/0154333 | A1 * | 6/2016 | Sun | G03G 9/09328 430/108.6 |
| 2016/0378003 | A1 | 12/2016 | Arimura et al. | |

FOREIGN PATENT DOCUMENTS

| | | | |
|---|---|---|---|
| JP | 2006154093 | A | 6/2006 |
| JP | 2011013441 | A | 1/2011 |
| JP | 2012063636 | A | 3/2012 |
| JP | 2012118511 | A | 6/2012 |
| JP | 2012220645 | A | 11/2012 |
| JP | 2013101336 | A | 5/2013 |
| JP | 2014095761 | A | 5/2014 |

OTHER PUBLICATIONS

U.S. Appl. No. 15/362,992, Satoshi Arimura, filed Nov. 29, 2016.
U.S. Appl. No. 15/366,295, Yoshitaka Suzumura, filed Dec. 1, 2016.

* cited by examiner

A-A CROSS SECTION

TONER, IMAGE FORMING APPARATUS, AND IMAGE FORMING METHOD

BACKGROUND OF THE INVENTION

Field of the Invention

The present invention relates to a toner for use in a recording method using electrophotography, or the like, an image forming apparatus provided with the toner, and an image forming method using the toner.

Description of the Related Art

An analog-to-digital transition, advanced recently in the field of printers and copiers, has resulted in excellent reproducibility of latent images and high resolution. At the same time, demand for reduction in size of, in particular, printers been growing strongly.

Printers have conventionally been used in a mode in which a printer is connected to a network and used for printing by a large number of users, but in recent years, it has been often required to install a personal computer (PC) and a printer on respective desks of the users so that printing is performed at hand. Accordingly, space-saving is required of printers and also printers reduced in size are strongly required.

Further, printers reduced in size also need to ensure high image quality and high stability with small variation in image in a long-term use. Accordingly, a printer can be effectively reduced in size by reducing the size of an image forming apparatus equipped with fixing means or developing means, which takes a significant volume of the printer.

Concerning an image forming method, a two-component development system or a mono-component development system is used in an image forming method for use in an image forming apparatus, but the mono-component development system is more suitable for size reduction. This is because members such as a carrier are not used. According to Japanese Patent Application Publication No. 2005-173484 and Japanese Patent Application Publication No. 2006-154093, an image forming apparatus using a mono-component development system can be reduced in size by reducing in the diameter size of a toner carrying member or by not using a toner supply member that is arranged in contact with the toner carrying member. However, problems specific to such image forming apparatuses tend to manifest strongly therein.

Examples of such problems include development ghosts associated with toner regulation defects on a toner carrying member. When the toner carrying member is reduced in diameter size or the toner supply member that is arranged in contact with the toner carrying member is not used, the replacement of toner on the toner carrying member becomes insufficient. As a result, the toner is overcharged and toner regulation defects are generated. Such toner regulation defects appear to be more significant when the flowability of the toner is decreased as a result of an external additive being embedded in the toner during a long-term durability use.

A cleaner-less system is also extremely effective as a means for reducing the size of an image forming apparatus. In most image forming apparatuses, the toner on an electrostatic latent image bearing member that remained in a transfer step (referred to hereinbelow as "untransferred toner") is scraped off with a cleaning blade and recovered in a cleaner container. Meanwhile, in the cleaner-less system, the cleaning blade and cleaner container are not used, which can result in significant size reduction of the image forming apparatus.

However, specific problems are also inherent to the cleaner-less system.

For example, in a portion of the electrostatic latent image bearing member where the untransferred toner is present, charging is implemented insufficiently in the charging step and non-uniformity is likely to occur during the development, hence image density non-uniformity is induced. Further, the external additive, which has been freed from the toner, remains on the electrostatic latent image bearing member even after the transfer step and contaminates the charging member, thereby causing charging defects and the appearance of white spots in a solid image.

Measures have been taken against the abovementioned development ghosts, image density non-uniformity, and white spots to increase the flowability of the toner and reduce a toner attachment force.

For example, Japanese Patent Application Publication No. H06-301236 suggests a magnetic toner configured of a binder resin, a magnetic body, and an external additive, the magnetic toner being characterized in that a toner fine powder to which the external additive has been attached is subjected to surface modification treatment by a hot air current in a dispersed state, and the immobilization of the external additive, coverage of the magnetic body, and sphering of the toner fine powder are performed simultaneously and instantaneously.

As a result of performing the so-called heat sphering treatment in such a manner, improvement in image quality and image stability during a long-term use are actually exhibited. However, in terms of preventing the abovementioned development ghosts, image density non-uniformity, and white spots, there is still room for further investigation and improvement.

SUMMARY OF THE INVENTION

The present invention provides a toner capable of providing an image in which development ghosts, image density non-uniformity, and white spots under a low-temperature and low-humidity environment are suppressed, an image forming apparatus provided with the toner, and an image forming method using the toner.

The present invention provides a toner comprising: a toner particle containing a binder resin and a colorant, and an inorganic fine particle A and an inorganic fine particle B present on a surface of the toner particle, wherein the inorganic fine particle A is a silica fine particle having a number-average particle diameter (D1) of primary particles of not less than 80 nm and not more than 200 nm;

the inorganic fine particle B has a number-average particle diameter (D1) of primary particles of not less than 5 nm and not more than 25 nm, and is at least one fine particle which is selected from a group consisting of a silica fine particle, a titanium oxide fine particle, and an alumina fine particle;

when a fixing ratio of the inorganic fine particle A to the toner particle is represented by a fixing ratio A and a fixing ratio of the inorganic fine particle B to the toner particle is represented by a fixing ratio B, a sum of the fixing ratio A and the fixing ratio B is 75% or more, where an inter-particle force measured after a load of 78.5 N is applied to the toner is Fp(A) and an inter-particle force measured after a load of 157.0 N is applied to the toner is Fp(B), the Fp(A) and the Fp(B) satisfy the following Formulas (1) and (2).

$$Fp(A) \leq 30.0 \text{ nN} \quad \text{Formula (1):}$$

$$(Fp(B)-Fp(A))/Fp(A) \leq 0.90 \quad \text{Formula (2):}$$

The present invention also provides an image forming apparatus including: an electrostatic latent image bearing member; a contact type charging roller that electrically charges the electrostatic latent image bearing member; image exposure means for forming an electrostatic latent image on a surface of the electrically charged electrostatic latent image bearing member; development means for developing the electrostatic latent image with a toner and forming a toner image; transfer means for transferring the toner image onto a transfer material via an intermediate transfer body or without the intermediate transfer body; and fixing means for fixing the toner image, which has been transferred onto the transfer material, to the transfer material, the image forming apparatus including no cleaning means for removing residual toner downstream of the transfer means and upstream of the contact type charging roller, and the residual toner being recovered by the development means, wherein the toner is the toner of the present invention.

The present invention also provides an image forming method including: a charging step of charging a surface of an electrostatic latent image bearing member by using a contact type charging roller; an electrostatic latent image forming step of exposing the electrically charged surface of the electrostatic latent image bearing member and forming an electrostatic latent image; a development step of developing the electrostatic latent image with a toner and forming a toner image; a transfer step of transferring the toner image onto a transfer material via an intermediate transfer body or without the intermediate transfer body; and a fixing step of fixing the toner image, which has been transferred onto the transfer material, to the transfer material, the image forming method including no cleaning step of removing residual toner between the transfer step and the charging step, and the residual toner being recovered by the development means, wherein the toner is the toner of the present invention.

The present invention can provide a toner capable of providing an image in which development ghosts, image density non-uniformity, and white spots under a low-temperature and low-humidity environment are suppressed, an image forming apparatus provided with the toner, and an image forming method using the toner.

Further features of the present invention will become apparent from the following description of exemplary embodiments (with reference to the attached drawings).

DESCRIPTION OF THE EMBODIMENTS

Figure 1:
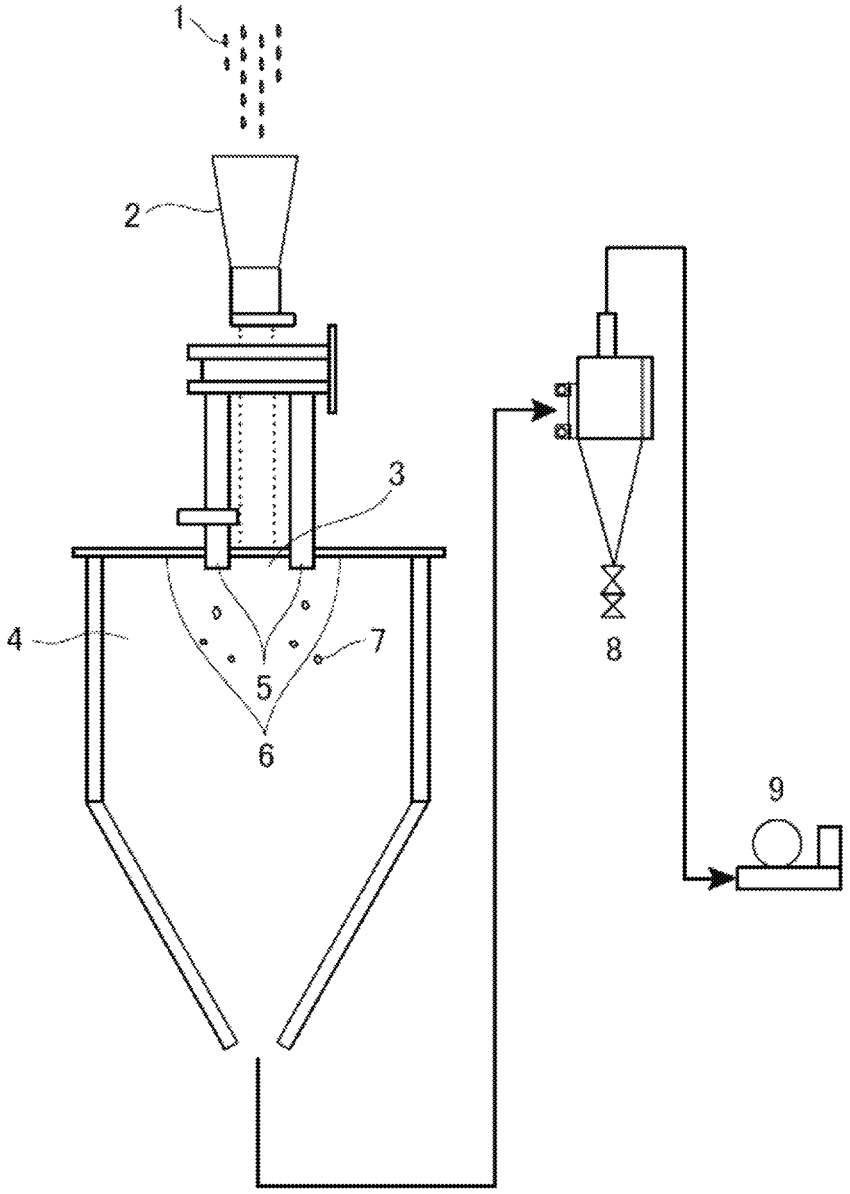
FIG. 1 is an outline diagram of a surface treatment device.

The toner of the present invention provides a toner comprising: a toner particle containing a binder resin and a colorant, and an inorganic fine particle A and an inorganic fine particle B present on a surface of the toner particle, wherein the inorganic fine particle A is a silica fine particle having a number-average particle diameter (D1) of primary particles of from 80 nm to 200 nm;

the inorganic fine particle B has a number-average particle diameter (D1) of primary particles of from 5 nm to 25 nm, and is at least one fine particle which is selected from a group consisting of a silica fine particle, a titanium oxide fine particle, and an alumina fine particle;

when a fixing ratio of the inorganic fine particle A to the toner particle is represented by a fixing ratio A and a fixing ratio of the inorganic fine particle B to the toner particle is represented by a fixing ratio B, a sum of the fixing ratio A and the fixing ratio B (a total fixing ratio) is 75% or more, where an inter-particle force measured after a load of 78.5 N is applied to the toner is Fp(A) and an inter-particle force measured after a load of 157.0 N is applied to the toner is Fp(B), the Fp(A) and the Fp(B) satisfy the following Formulas (1) and (2).

$$Fp(A) \leq 30.0 \text{ nN} \quad \text{Formula (1):}$$

$$(Fp(B)-Fp(A))/Fp(A) \leq 0.90 \quad \text{Formula (2):}$$

In the present invention, the wording "not less than . . . and not more than -" or "from . . . to -" means a range of numerical values including a lower limit and an upper limit as end points unless otherwise noted.

As mentioned hereinabove, where the flowability of the toner decreases as a result of an external additive being embedded during a long-term durability use, the replacement of the toner on the toner carrying member becomes insufficient. As a result, the toner is overcharged and toner regulation defects are caused. For this reason, there is a difference in the amount of the toner carried on the toner carrying member between the state after a solid black image output and the state after a solid white image output, and a development ghost appears. In order to prevent the appearance of such development ghost, a large amount of an external additive such as a small-diameter silica fine particle or a large-diameter silica fine particle has been conventionally added to maintain the flowability of the toner even during a long-term durability use, enhance the replacement of the toner on the toner carrying member, and prevent the toner regulation defects.

However, when the toner is likely to be overcharged, as under a low-temperature and low-humidity environment, the flowability of the toner becomes insufficient and sufficient effect cannot be obtained.

Further, when the toner to which a large amount of such external additive has been added is used in an image forming apparatus using a cleaner-less system, the external additive separated from the toner is likely to remain on the electrostatic latent image bearing member even after the transfer step, and the charging member is easily contaminated. As a result, charging defects appear and adverse effects such as the appearance of white spots in the image are likely to be observed. Further, with the toner to which a large amount of the external additive is simply added, the transfer efficiency is also insufficient. Therefore, the image density non-uniformity resulting from charging defects caused by the untransferred toner is also likely to occur.

As mentioned hereinabove, when the toner to which a large amount of an external additive has been added is used in an image forming apparatus using a cleaner-less system, it is difficult to realize both the suppression of development ghosts and the suppression of image density non-uniformity and white spots.

The results of the detailed investigation conducted by the inventors have demonstrated that both the suppression of development ghosts and the suppression of image density non-uniformity and white spots can be realized by specifying the types of inorganic fine particles present on the toner particle surface and the total fixing ratio thereof and also an inter-particle force at the time a predetermined load is applied to the toner.

Thus, by reducing the inter-particle force of the toner in a state in which the types of the inorganic fine particles have been specified and the total fixing ratio of the inorganic fine particles (the sum of the fixing ratio A and B) has been increased, it is possible to ensure instantaneous loosening of the toner in the vicinity of the toner regulating portion and improve charge rising performance of the toner.

Further, since the inter-particle force of the toner small, the transfer bias during transfer can be traced, and therefore, the transfer efficiency is increased, the amount of the untransferred toner is reduced, and the image density non-uniformity resulting from charging defects caused by the untransferred toner can be suppressed.

In addition, since the total fixing ratio of the inorganic fine particles is high, the amount of the inorganic fine particles remaining on the electrostatic latent image bearing member in the transfer step is reduced, contamination of the charging member can be suppressed, and white spots can be suppressed.

The present invention is described hereinbelow in detail, but this description is not intended to be limiting.

First, in the present invention, the inorganic fine particle A and the inorganic fine particle B that differ in particle diameter are present on the toner particle surface.

Since the inorganic fine particle A and the inorganic fine particle B that differ in particle diameter are present, the attachment force between toner particles can be reduced and flowability can be demonstrated over a longer period of time.

More specifically, the inorganic fine particle A is a silica fine particle with a number-average particle diameter (D1) of primary particles of from 80 nm to 200 nm. Where the inorganic fine particle A is such predetermined silica fine particle, the toner particles are in point contact, rather than surface contact, over a long-term durability use. Therefore, the attachment force between the toner particles can be reduced. As a result, the toner regulation defects can be suppressed. Further, the transfer efficiency of the toner rises, and the image density non-uniformity resulting from charging defects caused by the untransferred toner can be also suppressed.

It is preferred that the inorganic fine particle A be a silica fine particle with a number-average particle diameter (D1) of primary particles of from 80 nm to 150 nm.

Meanwhile, the inorganic fine particle B has a number-average particle diameter (D1) of primary particles of from 5 nm to 25 nm and is at least one fine particle selected from a group consisting of a silica fine particle, a titanium oxide fine particle, and an alumina fine particle.

Where the inorganic fine particle B is at least one fine particle which has the D1 of primary particles of 25 nm or less and is selected from a group consisting of a silica fine particle, a titanium oxide fine particle, and an alumina fine particle, the toner particle surface can be covered with the inorganic fine particle B. As a result, the attachment force between the toner particles can be reduced and the flowability of the toner is increased. As a consequence, the toner regulation defects can be suppressed. Further, the transfer efficiency of the toner rises, and the image density non-uniformity resulting from charging defects caused by the untransferred toner can be also suppressed.

Meanwhile, where the inorganic fine particle B is at least one fine particles which has the D1 of primary particles of 5 nm or more and is selected from a group consisting of a silica fine particle, a titanium oxide fine particle, and an alumina fine particle, the inorganic fine particle is unlikely to be buried in the toner particle surface and the attachment force between the toner particles can be reduced even during a long-term durability use.

It is preferred that the inorganic fine particle B has a number-average particle diameter (D1) of primary particles of from 5 nm to 15 nm.

Further, where the inorganic fine particle B is at least one fine particle selected from a group consisting of a silica fine particle, a titanium oxide fine particle, and an alumina fine particle, the attachment force between the toner particles can be reduced.

In the present invention, when a fixing ratio of the inorganic fine particle A to the toner particle is represented by a fixing ratio A and a fixing ratio of the inorganic fine particle B to the toner particle is represented by a fixing ratio B, a sum of the fixing ratio A and the fixing ratio B to the toner particle (the total fixing ratio) is 75% or more, preferably from 85% to 100%. The total fixing ratio being 75% or more means that the inorganic fine particle A and the inorganic fine particle B are fixed in a state in which they are unlikely to separate from the toner particle and the inorganic fine particle A and the inorganic fine particle B are unlikely to remain on the electrostatic latent image bearing member after the transfer step.

Therefore, even when an image forming apparatus using a cleaner-less system is used, the charging member is unlikely to be contaminated and white spots in a solid image can be suppressed over a long-term durability use.

For example, the following methods, or combinations thereof, can be used for controlling the total fixing ratio of the inorganic fine particle A and the inorganic fine particle B to the abovementioned range (that is, for increasing the total fixing ratio).

(1) The surface composition of the toner particle is made uniform.

(2) The circularity of the toner is increased.

(3) The inorganic fine particle B is externally added to the toner particle after the inorganic fine particle A has been externally added.

(4) Hot air current treatment is performed after the inorganic fine particle A has been externally added to the toner.

(5) The inorganic fine particle A is externally added by a mixing device capable of strongly fixing the inorganic fine particle to the toner particle.

(6) The inorganic fine particle B is externally added by a mixing device capable of uniformly fixing the inorganic fine particle to the toner particle.

(7) The type and particle diameter of the inorganic fine particle A and the inorganic fine particle B are specified as mentioned hereinabove.

(8) The half width of the maximum peak in the particle size distribution of the inorganic fine particle A is reduced.

In the present invention, a consolidated toner layer is formed by applying a load of 78.5 N or 157.0 N to a toner accommodated in a vertically split cylindrical cell, the upper cell is then lifted, the toner layer is stretched, and an inter-particle force is calculated from the maximum tensile fracture force at the time the toner layer is fractured.

With the toner of the present invention, where an inter-particle force measured after a load of 78.5 N is applied to the toner is Fp(A) and an inter-particle force measured after a load of 157.0 N is applied to the toner is Fp(B), the following Formulas (1) and (2) are satisfied.

$$Fp(A) \leq 30.0 \text{ nN} \quad \text{Formula (1):}$$

$$(Fp(B)-Fp(A))/Fp(A) \leq 0.90 \quad \text{Formula (2):}$$

Here, the compression conditions of 78.5 N and 157.0 N are the values obtained by assuming that the load is applied when the toner consolidated inside a process cartridge passes through a regulating portion.

Toner carrying members with an outer diameter of from about 10 mm to about 14 mm have recently been often used to reduce the printer in size. An axial torque applied to such a small-diameter toner carrying member is from about 0.1 N·m to about 0.3 N·m. Therefore, a force of from about 20 N to about 60 N is applied between the surface of the toner carrying member and a regulating blade. Where the toner carrying members will be further reduced in size in the future, it can be anticipated that a larger force will be applied at the regulating portion.

Therefore, a load of 78.5 N is a value determined by assuming that a load which is about 20% higher than the conventional load will be applied and the degraded toner after a durability use will be thrust into the regulating portion, this assumption taking into consideration the reduction of printers in size.

Meanwhile, a load of 157.0 N is a value determined by assuming that the flowability of the toner will be reduced by half, that is, that the toner will be degraded by a durability use and will be further consolidated, in such process cartridge configuration that will be used in the future. Thus, a large load can be applied when the toner which has been extremely consolidated inside the process cartridge after long-term storage is thrusted onto the regulating member after a durability use.

It was found that where Fp(A) is 30.0 nN or less, the toner regulation defects can be suppressed and the development ghosts are reduced. The reason therefor is unclear, but the following explanation can be suggested. Where Fp(A) is 30.0 nN or less, the toner particles adjacent to the regulating portion in the process cartridge can be present in a state close to that of point contact with each other through the inorganic fine particle A and the inorganic fine particle B.

Since such a state is obtained, the replacement ability in the vicinity of the regulating portion is improved, the overcharge of the toner can be suppressed, and a uniform charge distribution can be obtained. As a result, the toner regulation defects can be suppressed and the development ghosts are reduced.

Further, where Fp(A) is 30.0 nN or less, image density non-uniformity can be suppressed.

This can be explained as follows.

As mentioned hereinabove, since the toner particles can be present in a state close to that of point contact with each other through the inorganic fine particle A and the inorganic fine particle B and uniform charge distribution can be obtained, the transfer efficiency is increased and the amount of untransferred toner is reduced. Thus, charging by the charging member in the charging step becomes uniform which makes it possible to suppress the image density non-uniformity.

For this reason, Fp(A) is 30.0 nN or less, and more preferably Fp(A) is from 10 nN to 25.0 nN. Where Fp(A) is 25.0 nN or less, the development ghosts and image density non-uniformity can be further suppressed.

Where (Fp(B)−Fp(A))/Fp(A) is 0.90 or less, toner aggregates can be easily loosened in the vicinity of the regulating portion even during a long-term durability use. Therefore, the charge rising performance of the toner is satisfactory, the toner can be uniformly charged, and the development ghosts can be suppressed.

Further, where (Fp(B)−Fp(A))/Fp(A) is 0.90 or less, image density non-uniformity can be suppressed even during a long-term durability use.

For this reason, (Fp(B)−Fp(A))/Fp(A) is 0.90 or less, and more preferably (Fp(B)−Fp(A))/Fp(A) is from 0.30 to 0.60. Where (Fp(B)−Fp(A))/Fp(A) is 0.60 or less, the development ghosts and image density non-uniformity can be further suppressed over a long-term durability use.

A method of increasing the above-described total fixing ratio of the inorganic fine particle A and the inorganic fine particle B with respect to the toner particle is effective for adjusting Fp(A) and Fp(B) to the abovementioned ranges. A method of controlling the ratio of coverage of the toner particle surface with the inorganic fine particle B is also effective.

Components contained in the toner of the present invention will be described hereinbelow.

First, the colorant will be described.

For example, carbon black, a magnetic body, and the colorants toned in black by using the below-described yellow, magenta, and cyan colorants can be used as the black colorant.

As mentioned hereinabove, a mono-component development system is effective means for reducing a printer in size. Other effective means is to omit the supply roller that supplies the toner in the process cartridge to the toner carrying member. A magnetic mono-component development system is preferred as the mono-component development system in which the supply roller is omitted, and a magnetic toner using a magnetic body as a colorant for the toner is also preferred. As a result of using such magnetic toner, high transport performance and coloring performance are ensured.

Further, in order to obtain uniform attachment and high fixing performance of the inorganic fine particle A, it is more preferred that a magnetic toner particle using a magnetic body with a high specific gravity be used.

For example, when heat sphering treatment is performed by a hot air current after the inorganic fine particle A has been externally added to the toner particle, the presence of the magnetic body inside the toner particle makes it possible to prevent the inorganic fine particle A from being buried in the toner particle. Therefore, both uniform attachment and high fixing performance are easily realized.

Further, for example, a mixing device using a stirring blade, or the like, is used to ensure mixing performance and shear force for causing the attachment of an external additive such as an inorganic fine particle to a toner particle. In such external addition step, a portion where the external addition treatment is mainly executed is in the vicinity of the stirring blade. In the vicinity of the stirring blade, a load acting during the external addition treatment on a nonmagnetic toner particle with a low specific gravity is sometimes reduced. Meanwhile, a load acting during the external addition treatment in the vicinity of the stirring blade on a magnetic toner particle with a high specific gravity is apparently larger than that acting on the nonmagnetic toner particle, and the intensity of the external addition treatment further increases. Therefore, higher fixing performance of the inorganic fine particle can be obtained with a magnetic toner particle than with a nonmagnetic toner particle.

The magnetic body includes triiron tetraoxide or γ-iron oxide as the main component and may include elements such as phosphorus, cobalt, nickel, copper, magnesium, manganese, aluminum, and silicon.

The BET specific area of the magnetic body measured by a nitrogen adsorption method is preferably from 2 $m^2/g$ to 30 $m^2/g$, and more preferably from 3 $m^2/g$ to 28 $m^2/g$. The Mohs hardness of the magnetic body is preferably from 5 to 7.

The magnetic body can have a polyhedral, octahedral, hexahedral, spherical, needle-like, and flaky shape, but in terms of increasing the image density a polyhedral, octahedral, hexahedral, or spherical shape is preferred because of a small anisotropy.

The number-average particle diameter of the magnetic bodies is preferably from 0.10 μm to 0.40 μm. Where the number-average particle diameter is 0.10 μm or more, the magnetic bodies are unlikely to aggregate and uniform dispersibility of the magnetic bodies in the toner particle is improved. Further, it is preferred that the number-average particle diameter be 0.40 μm or less because a tinting strength of the toner is increased.

The number-average particle diameter of the magnetic bodies can be measured using a transmission electron microscope. More specifically, a toner which is to be observed is thoroughly dispersed in an epoxy resin. A cured product is then obtained by curing for 2 days in an atmosphere with a temperature of 40° C. The obtained cured product is sliced into thin samples with a microtome, observations are performed under a magnification of from 10,000 to 40,000 by using a transmission electron microscope (TEM), and the particle diameter of 100 magnetic bodies in a field of view is measured. The number-average particle diameter is calculated on the basis of the equivalent diameter of a circle which is equal to the magnetic body in a projection area.

The magnetic body can be produced, for example, by the following method.

An alkali such as sodium hydroxide is added, in an equivalent or more with respect to an iron component, to an aqueous ferrous salt solution to preparer an aqueous solution of ferrous hydroxide.

Air is blown into the prepared aqueous solution while maintaining the pH thereof at pH 7 or more, and an oxidation reaction of ferrous hydroxide is performed while warming the aqueous solution to 70° C. or more, thereby producing seed crystals which will become the core of the magnetic iron oxide.

Then, an aqueous solution containing about one equivalent of ferrous sulfate, based on the previously added amount of alkali, is added to the seed crystal-containing slurry-like liquid, thereby providing a mixed liquid. The reaction of ferrous hydroxide is advanced, while blowing in air and maintaining the pH of the resulting mixed liquid at from 5 to 10, thereby growing magnetic iron oxide around the seed crystals as the cores. By selecting the desired pH, reaction temperature and stirring conditions at this time, it is possible to control the shape and magnetic properties of the magnetic body. As the oxidation reaction proceeds, the pH of the aqueous solution shifts to the acidic side, although it is preferable to keep the pH of the aqueous solution from falling below 5. By filtering, washing and drying the resulting magnetic body in accordance with common practice, a magnetic body can be obtained.

The content of the magnetic body in the toner is preferably from 20 mass % to 60 mass %, and more preferably from 25 mass % to 50 mass %.

Where the content of the magnetic body is from 20 mass % to 60 mass %, tinting power can be demonstrated. Further, as mentioned hereinabove, since the fixing state of the inorganic fine particle A can be easily controlled, the interparticle force can be easily controlled.

The content of the magnetic body in the toner can be measured using a thermal analyzer TGA Q5000IR manufactured by Perkin-Elmer Co., Ltd.

A sample is prepared in the following manner.

The toner is placed in isopropanol, which does not dissolve the toner, and subjected to vibrations for 10 min in an ultrasonic cleaning device. The toner and solution are then separated in a centrifugal separator (5 min at 1000 rpm). The supernatant is separated, and the precipitated toner is vacuum dried to provide a measurement sample.

The measurement method is described below.

The measurement sample is heated from normal temperature to 900° C. at a temperature increase rate of 25° C./min under a nitrogen atmosphere, a mass loss in a range from 100° C. to 750° C. is taken as the mass of the component obtained by removing the magnetic body from the measurement sample, and the remaining mass is taken as a magnetic body amount.

Examples of colorants other than the magnetic body include the following well-known dyes and pigments.

Examples of yellow colorants include compounds represented by condensed azo compounds, isoindolinone compounds, anthraquinone compounds, azo metal complexes, methine compounds, and allylamide compounds.

Specific examples include C. I. Pigment Yellow 12, 13, 14, 15, 17, 62, 73, 74, 83, 93, 94, 95, 97, 109, 110, 111, 120, 128, 129, 138, 147, 150, 151, 154, 155, 168, 180, 185, and 214.

Examples of magenta colorants include condensed azo compounds, diketopyrrolopyrrole compounds, anthraquinone compounds, quinacridone compounds, basic dye lake compounds, naphthol compounds, benzimidazolone compounds, thioindigo compounds, and perylene compounds.

Specific examples include C. I. Pigment Red 2, 3, 5, 6, 7, 23, 48:2, 48:3, 48:4, 57:1, 81:1, 122, 146, 166, 169, 177, 184, 185, 202, 206, 220, 221, 238, 254, 269, and C. I. Pigment Violet 19.

Examples of cyan colorants include copper phthalocyanine compounds and derivatives thereof, anthraquinone compounds, and basic dye lake compounds.

Specific examples include C. I. Pigment Blue 1, 7, 15, 15:1, 15:2, 15:3, 15:4, 60, 62, and 66.

These colorants can be used individually or as a mixture, and also in a state of solid solution. The colorants are selected with consideration for the hue angle, chroma, lightness, lightfastness, OHP transparency, and dispersibility in the toner particle. The amount added of these colorants is preferably from 1 part by mass to 20 parts by mass with respect to 100 parts by mass of the binder resin.

Examples of the binder resin include polyester resins, vinyl resins, epoxy resins, and polyurethane resins.

Examples of the vinyl resins include styrene-based resins.

Specific examples of the styrene-based resins include polystyrene, styrene-propylene copolymer, styrene-vinyl toluene copolymer, styrene-methyl acrylate copolymer, styrene-ethyl acrylate copolymer, styrene-butyl acrylate copolymer, styrene-octyl acrylate copolymer, styrene-methyl methacrylate copolymer, styrene-ethyl methacrylate copolymer, styrene-butyl methacrylate copolymer, styrene-octyl methacrylate copolymer, styrene-butadiene copolymer, styrene-isoprene copolymer, styrene-maleic acid copolymer, and styrene-maleic acid ester copolymer. These resins can be used individually or in combinations of a plurality thereof.

Examples of monomers constituting the styrene-based resins are presented below.

Styrene; styrene derivatives such as o-methyl styrene, m-methyl styrene, p-methyl styrene, p-methoxystyrene, p-phenyl styrene, p-chlorostyrene, 3,4-dichlorostyrene, p-ethyl styrene, 2,4-dimethyl styrene, p-n-butyl styrene, p-tert-butyl styrene, p-n-hexyl styrene, p-n-octyl styrene, p-n-nonyl styrene, p-n-decyl styrene, and p-n-dodecyl styrene; unsaturated monoolefins such as ethylene, propylene, butylene, and isobutylene; unsaturated polyenes such as butadiene and isoprene; halogenated vinyls such as vinyl chloride, vinylidene chloride, vinyl bromide, and vinyl fluoride; vinyl esters such as vinyl acetate, vinyl propionate, and vinyl benzoate; α-methylene aliphatic monocarboxylic acid esters such as methyl methacrylate, ethyl methacrylate, propyl methacrylate, n-butyl methacrylate, isobutyl methacrylate, n-octyl methacrylate, dodecyl methacrylate, 2-ethylhexyl methacrylate, stearyl methacrylate, phenyl methacrylate, dimethylaminoethyl methacrylate, and diethylaminoethyl methacrylate; acrylic acid esters such as methyl acrylate, ethyl acrylate, n-butyl acrylate, isobutyl acrylate, propyl acrylate, n-octyl acrylate, dodecyl acrylate, 2-ethylhexyl acrylate, stearyl acrylate, 2-chloroethyl acrylate, and phenyl acrylate; vinyl ethers such as vinyl methyl ether, vinyl ethyl ether, and vinyl isobutyl ether; vinyl ketones such as vinyl methyl ketone, vinyl hexyl ketone, and methyl isopropenyl ketone; N-vinyl compounds such as N-vinyl pyrrole, N-vinyl carbazole, N-vinyl indole, and N-vinyl pyrrolidone; vinyl naphthalenes; and acrylic acid or methacrylic acid derivatives such as acrylonitrile, methacrylonitrile, and acrylamide.

Other examples include unsaturated dibasic acids such as maleic acid, citraconic acid, itaconic acid, alkenylsuccinic acid, fumaric acid, and mesaconic acid; unsaturated dibasic acid anhydrides such as maleic anhydride, citraconic anhydride, itaconic anhydride, and alkenylsuccinic anhydride; half esters of unsaturated dibasic acids such as methyl maleate half ester, ethyl maleate half ester, butyl maleate half ester, methyl citraconate half ester, ethyl citraconate half ester, butyl citraconate half ester, methyl itaconate half ester, methyl alkenylsuccinate half ester, methyl fumarate half ester, and methyl mesaconate half ester; unsaturated dibasic acid esters such as dimethylmaleic acid and dimethylfumaric acid; α, β-unsaturated acids such as acrylic acid, methacrylic acid, crotonic acid, and cinnamic acid; α, β-unsaturated acid anhydrides and anhydrides of α, β-unsaturated acids and lower fatty acids such as crotonic anhydride and cinnamic anhydride; and monomers having a carboxyl group such as alkenylmalonic acid, alkenylglutaric acid, alkenyladipic acid, and anhydrides of these acids and monoesters thereof.

Other examples include acrylic acid or methacrylic acid esters such as 2-hydroxyethyl acrylate, 2-hydroxyethyl methacrylate, and 2-hydroxypropyl methacrylate; and monomers having a hydroxyl group such as 4-(1-hydroxy-1-methylbutyl)styrene and 4-(1-hydroxy-1-methylhexyl) styrene.

The binder resin for the toner of the present invention is preferably a styrene-based resin.

Among them, styrene-butyl acrylate copolymer and styrene-butyl methacrylate copolymer are preferred because the branching degree and resin viscosity can be easily adjusted and, therefore, the developing performance can be easily maintained over a long period of time.

The styrene-based resin may have a crosslinked structure obtained by crosslinking with a crosslinking agent having two or more vinyl groups. Examples of the crosslinking agent that can be used in this case are presented below.

Examples of aromatic divinyl compounds include divinylbenzene and divinyl naphthalene.

Examples of diacrylate compounds bonded by an alkyl chain include ethylene glycol diacrylate, 1,3-butylene glycol diacrylate, 1,4-butane diol diacrylate, 1,5-pentane diol diacrylate, 1,6-hexane diol diacrylate, neopentyl glycol diacrylate, and the aforementioned compounds in which acrylate is replaced with methacrylate.

Examples of diacrylate compounds bonded by an alkyl chain including an ether bond include diethylene glycol diacrylate, triethylene glycol diacrylate, tetraethylene glycol diacrylate, polyethylene glycol #400 diacrylate, polyethylene glycol #600 diacrylate, dipropylene glycol diacrylate, and the aforementioned compounds in which acrylate is replaced with methacrylate.

Examples of diacrylate compounds bonded by a chain including an aromatic group and an ether bond include polyoxyethylene (2)-2,2-bis(4-hydroxyphenyl)propane diacrylate, polyoxyethylene (4)-2,2-bis(4-hydroxyphenyl)propane diacrylate, and the aforementioned compounds in which acrylate is replaced with methacrylate.

MANDA (trade name; produced by Nippon Kayaku Co., Ltd) is an example of a polyester-type diacrylate compound.

Examples of polyfunctional crosslinking agents include pentaerythritol triacrylate, trimethylolethane triacrylate, trimethylolpropane triacrylate, tetramethylolmethane tetraacrylate, oligoester acrylates, the aforementioned compounds in which acrylate is replaced with methacrylate; and also triallyl cyanurate and triallyl trimellitate.

Among these crosslinkable monomers, diacrylate compounds bonded by a chain including an aromatic divinyl compound (in particular, divinylbenzene), an aromatic group, and an ether bond can be advantageously used because durability is increased.

Alcohol components and acid components that can be used when producing the polyester resin are presented below.

It is preferred that an aliphatic diol be included as a dihydric alcohol component. Examples of the aliphatic diols include ethylene glycol, diethylene glycol, triethylene glycol, 1,2-propylene glycol, 1,3-propylene glycol, dipropylene glycol, 1,4-butanediol, 1,4-butadiene glycol, trimethylene glycol, tetramethylene glycol, pentamethylene glycol, hexamethylene glycol, octamethylene glycol, nonamethylene glycol, decamethylene glycol, and neopentyl glycol.

Examples of aromatic diols include bisphenols and derivatives thereof represented by Formula I below and diols represented by Formula II below.

(I)

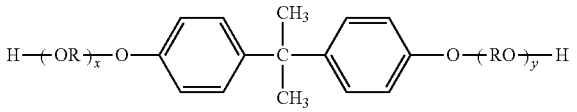

(in the formula, R is an ethylene group or a propylene group; x and y are integers of 0 or more, the average value of x+y is from 0 to 10).

(II)

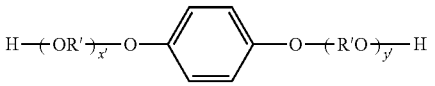

(in the formula, R' is

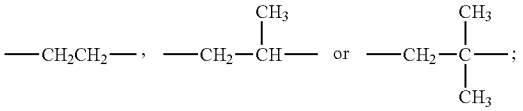

x' and y' are integers of 0 or more, and the average value of x'+y' is from 0 to 10).

Examples of the divalent acid component include the following dicarboxylic acids and derivatives thereof.

Benzenedicarboxylic acids and anhydrides thereof such as phthalic acid, terephthalic acid, isophthalic acid, and phthalic anhydride, or lower alkyl esters thereof; alkyldicarboxylic acids such as succinic acid, adipic acid, sebacic acid, and azelaic acid, anhydrides thereof, or lower alkyl esters thereof; alkenylsuccinic acids or alkylsuccinic acids such as n-dodecenylsuccinic acid and n-dodecylsuccinic acid, anhydrides thereof, or lower alkyl esters thereof; and unsaturated dicarboxylic acids such as fumaric acid, maleic acid, citraconic acid, and itaconic acid, anhydrides thereof, or lower alkyl esters thereof.

From the standpoint of achieving uniform dispersibility of the magnetic body or wax, it is preferred that a trihydric or higher alcohol component or a trivalent or higher acid component, which acts as a crosslinking component, be also used.

Examples of trihydric and higher polyhydric alcohol component include sorbitol, 1,2,3,6-hexanetetrol, 1,4-sorbitan, pentaerythritol, dipentaerythritol, tripentaerythritol, 1,2,4-butanetriol, 1,2,5-pentanetriol, glycerol, 2-methylpropanetriol, 2-methyl-1,2,4-butanetriol, trimethylolethane, trimethylolpropane, and 1,3,5-trihydroxybenzene.

Examples of trivalent and higher polyvalent carboxylic acid component include trimellitic acid, pyromellitic acid, 1,2,4-benzenetricarboxylic acid, 1,2,5-benzenetricarboxylic acid, 2,5,7-naphthalenetricarboxylic acid, 1,2,4-naphthalenetricarboxylic acid, 1,2,4-butanetricarboxylic acid, 1,2,5-hexanetricarboxylic acid, 1,3-dicarboxy-2-methyl-2-methylenecarboxypropane, tetra(methylenecarboxyl)methane, 1,2,7,8-octanetetracarboxylic acid, Empol trimer acid, and anhydrides thereof.

The amount of the alcohol component in the total amount of the acid component and the alcohol component is preferably from 40 mol % to 60 mol %, and more preferably from 45 mol % to 55 mol %. A generally well-known polycondensation method may usually be used to produce the abovementioned polyester resin.

The glass transition temperature (Tg) of the binder resin is preferably from 45° C. to 70° C. Where Tg is 45° C. or more, developing performance over a long period of time is likely to improve, and where Tg is 70° C. or less, low-temperature fixability tends to improve.

The toner particle may include a wax.

Examples of the wax include waxes mainly composed of fatty acid esters, such as carnauba wax and montanic acid ester wax; partially or entirely deoxidized fatty acid esters such as deoxidized carnauba wax; methyl ester compounds each having a hydroxyl group which are obtained by hydrogenation of vegetable oils and fats; saturated fatty acid monoesters such as stearyl stearate and behenyl behenate; diesterified products of saturated aliphatic dicarboxylic acids and saturated aliphatic alcohols, such as dibehenyl sebacate, distearyl dodecanedioate, and distearyl octadecanedioate; diesterified products of saturated aliphatic diols and saturated fatty acids such as nonanediol dibehenate and dodecanediol distearate; aliphatic hydrocarbon-based waxes such as low-molecular weight polyethylene, low-molecular weight polypropylene, a microcrystalline wax, a paraffin wax, and a Fischer-Tropsch wax; oxides of aliphatic hydrocarbon-based waxes such as a polyethylene oxide wax, or block copolymers thereof; and waxes obtained by grafting vinyl-based monomers such as styrene and acrylic acid onto aliphatic hydrocarbon-based waxes; saturated linear fatty acids such as palmitic acid, stearic acid, and montanic acid; unsaturated fatty acids such as brassidic acid, eleostearic acid, and parinaric acid; saturated alcohols such as stearyl alcohol, aralkyl alcohol, behenyl alcohol, carnaubyl alcohol, ceryl alcohol, and melissyl alcohol; polyhydric alcohols such as sorbitol; fatty acid amides such as linoleic acid amide, oleic acid amide, and lauric acid amide; saturated fatty acid bisamides such as methylenebis(stearic acid amide), ethylenebis(capric acid amide), ethylenebis(lauric acid amide), and hexamethylenebis(stearic acid amide); unsaturated fatty acid amides such as ethylenebis(oleic acid amide), hexamethylenebis(oleic acid amide), N,N'-dioleyl adipic acid amide, and N,N'-dioleyl sebacic acid amide; aromatic bisamides such as m-xylenebis(stearic acid amide) and N,N'-distearyl isophthalic acid amide; aliphatic metal salts (generally referred to as metal soaps) such as calcium stearate, calcium laurate, zinc stearate, and magnesium stearate; and long-chain alkyl alcohols or long-chain alkyl carboxylic acids each having 12 or more carbon atoms.

Among those waxes, monofunctional or bifunctional ester waxes, such as saturated fatty acid monoesters and diesterified products, and hydrocarbon waxes, such as a paraffin wax and a Fisher-Tropsch wax, are preferred.

It is preferred that the wax have a maximum endothermic peak in a range from 60° C. to 85° C. at the time of a temperature increase in a differential scanning calorimeter (DSC) curve measured with a DSC. As a result of the maximum endothermic peak being in the abovementioned temperature range, the low-temperature fixability and development stability are improved.

Further, the melting point of the wax defined by the peak temperature of the maximum endothermic peak at the time of a temperature increase in a differential scanning calorimeter (DSC) curve measured with a DSC is preferably from 60° C. to 140° C., more preferably from 60° C. to 90° C. Where the melting point is 60° C. or more, the storage stability of the toner is improved. Meanwhile, where the melting point is 140° C. or less, the low-temperature fixability is likely to improve.

The content of the wax is preferably from 3 parts by mass to 30 parts by mass with respect to 100 parts by mass of the binder resin. Where the content of the wax is 3 parts by mass or more, the low-temperature fixability is likely to improve. Meanwhile, where the content of the wax is 30 parts by mass or less, the toner is unlikely to degrade in a long-term use and image stability is likely to improve.

The toner particle may contain a charge control agent. Further, the toner of the present invention is preferably a negative-charging toner.

An organic metal complex compound or a chelate compound is effective as a charge control agent for negative charging. Examples thereof include: a monoazo metal complex compound; an acetylacetone metal complex compound; and a metal complex compound of an aromatic hydroxycarboxylic acid or an aromatic dicarboxylic acid.

Specific examples of commercially available products include Spilon Black TRH, T-77, and T-95 (Hodogaya Chemical Co., Ltd.) and BONTRON (registered trademark) S-34, S-44, S-54, E-84, E-88, and E-89 (produced by Orient Chemical Industries Co., Ltd.).

Those charge control agents may be used individually or in combinations of two or more thereof.

From the standpoint of charge quantity of the toner, the content of the charge control agent is preferably from 0.1 part by mass to 10.0 parts by mass, and more preferably from 0.1 part by mass to 5.0 parts by mass with respect to 100 parts by mass of the binder resin.

From the standpoint of the ease of controlling the particle size distribution, it is preferred that the inorganic fine particle A be a silica fine particle produced by a sol-gel method.

The sol-gel method is a method of forming particles through solvent removal from, and drying of, a silica sol suspension liquid obtained by subjecting an alkoxysilane to a hydrolysis and condensation reaction with a catalyst in a water-containing organic solvent. The silica fine particles obtained by the sol-gel method have appropriate particle diameters and a narrow particle size distribution and are monodispersed and spherical. Therefore, the silica fine particles are likely to disperse uniformly on the surface of the toner particle and can reduce the inter-particle force through a stable spacer effect.

Further, as a result of setting the number-average particle diameter (D1) of the primary particles of the inorganic fine particles A to from 80 nm to 200 nm, it is possible to control the total fixing ratio and ensure the effect of the inorganic fine particles as spacer particles through a durability use.

The inorganic fine particle A preferably has a half width of the maximum peak, in the particle size distribution of primary particles, of 25 nm or less, more preferably from 5 nm to 20 nm. Further, sol-gel silica obtained by the sol-gel method are spherical and monodispersed, but some of them are present in a coalesced form. Where the half width of the maximum peak in the particle size distribution of primary particles is 25 nm or less, the amount of such coalesced particles is small, and the ability of the inorganic fine particles A to be attached uniformly to the toner particle is improved and higher flowability is obtained. As a result, the uniform charging performance and charge buildup performance of the toner are further improved. This effect becomes more significant in the case of toner having an average circularity of 0.960 or more.

A production method for silica fine particles based on the sol-gel method is described hereinbelow.

First, an alkoxysilane is subjected to a hydrolysis and condensation reaction with a catalyst in a water-containing organic solvent to provide a silica sol suspension liquid. Then, the solvent is removed from the silica sol suspension liquid and the residue is dried to provide the silica fine particles.

The silica fine particles thus obtained are usually hydrophilic and have a large number of silanol groups on the surface. Accordingly, it is preferred that the surface of the silica fine particles be subjected to hydrophobizing treatment.

Examples of methods for the hydrophobizing treatment include a method of removing the solvent from the silica sol suspension liquid, drying, and then treating with a hydrophobizing treatment agent, and a method of directly adding a hydrophobizing treatment agent to the silica sol suspension liquid to perform the treatment simultaneously with the drying.

From the standpoint of controlling the half width and controlling the saturated moisture adsorption amount, a technique of directly adding a hydrophobizing treatment agent to the silica sol suspension liquid is preferred. Through the hydrophobizing treatment in the suspension liquid, the sol-gel silica can be subjected to the hydrophobizing treatment while being present in a monodispersed form. Therefore, aggregated lumps are unlikely to be generated after the drying, and uniform coating can be performed.

Further, it is more preferred that the pH of the silica sol suspension liquid be acidic. Where the suspension liquid is made acidic, reactivity with the hydrophobizing treatment agent is increased, and stronger and more uniform hydrophobizing treatment can be performed.

Examples of the hydrophobizing treatment agent are presented hereinbelow.

γ-(2-Aminoethyl)aminopropyltrimethoxysilane, γ-(2-aminoethyl)aminopropylmethyldimethoxysilane, γ-methacryloxypropyltrimethoxysilane, N-β-(N-vinylbenzylaminoethyl)-γ-aminopropyltrimethoxysilane hydrochloride, hexamethyldisilazane, methyltrimethoxysilane, butyltrimethoxysilane, isobutyltrimethoxysilane, hexyltrimethoxysilane, octyltrimethoxysilane, decyltrimethoxysilane, dodecyltrimethoxysilane, phenyltrimethoxysilane, o-methylphenyltrimethoxysilane, p-methylphenyltrimethoxysilane, methyltriethoxysilane, butyltriethoxysilane, hexyltriethoxysilane, octyltriethoxysilane, decyltriethoxysilane, dodecyltriethoxysilane, phenyltriethoxysilane, o-methylphenyltriethoxysilane, and p-methylphenyltriethoxysilane.

Further, the silica fine particles may be subjected to pulverizing treatment in order to facilitate the monodispersion of the silica fine particles on the toner particle surface or to exhibit a stable spacer effect.

The inorganic fine particles A preferably have an apparent density of from 150 g/L to 300 g/L. The apparent density of the inorganic fine particles A falling within the above-mentioned range means that the inorganic fine particles are unlikely to be densely packed, are present while trapping a large amount of air between the fine particles, and have an extremely low apparent density. Accordingly, a mixing property between the toner particles and the silica fine particles A is likely to improve in the external addition step, and hence a uniform coverage state is likely to be obtained. In addition, this phenomenon tends to be more significant, leading to a higher coverage ratio, when the average circularity of the toner is high. As a result, the toner particles of the toner after external addition are unlikely to be densely packed, and therefore the attachment force between the toner particles is likely to decrease.

Examples of means for controlling the apparent density of the inorganic fine particles A to the above-mentioned range include hydrophobizing treatment in the silica sol suspension liquid or the adjustment of the intensity of the pulverizing treatment after the hydrophobizing treatment, and the adjustment of a hydrophobizing treatment amount. Where uniform hydrophobizing treatment is performed, the amount of relatively large aggregates themselves can be reduced. Alternatively, through the adjustment of the intensity of the pulverizing treatment, relatively large aggregates contained in the silica fine particles after drying can be loosened into relatively small secondary particles, and the apparent density can be lowered.

Herein, it is preferred that the inorganic fine particles A be added in an amount of from 0.1 part by mass to 10.0 parts by mass with respect to 100 parts by mass of the toner particles. When the amount added of the inorganic fine particles A is within the abovementioned range, the total fixing ratio and the uniform diffusion state of the inorganic fine particles B on the toner particle surface can be easily controlled and the inter-particle force of the toner can be easily controlled to a predetermined range.

The inorganic fine particle B is at least one fine particle selected from the group consisting of a silica fine particle, a titanium oxide fine particle, and an alumina fine particle.

Among them, from the standpoint of controlling the flowability and charging performance of the toner, it is preferred that a silica fine particle be included.

The silica fine particle as the inorganic fine particle B is preferably a fine particle generated by the vapor-phase oxidation of a silicon halide compound, that is, a particle which is called dry process silica or fumed silica.

For example, such silica is produced by utilizing a thermal decomposition oxidation reaction of a silicon tetrachloride gas in oxygen and hydrogen, and a basic reaction formula for the reaction is as follows;

$$SiCl_4+2H_2+O_2 \rightarrow SiO_2+4HCl.$$

In the production process, a composite fine particle of silica and another metal oxide can also be obtained, for example, by using a silicon halide compound with another metal halide compound, such as aluminum chloride and titanium chloride, and the silica is also inclusive of such composite fine particle.

In addition, the silica fine particle generated by the vapor-phase oxidation of the silicon halide compound is more preferably a hydrophobized silica fine particle having a surface subjected to hydrophobizing treatment. It is particularly preferred that the hydrophobized silica fine particle be obtained by subjecting the silica fine particle to treatment such that a hydrophobizing degree measured by a methanol titration test has a value in a range from 30 to 80.

The hydrophobizing treatment can be performed by a method involving chemical treatment with an organosilicon compound and/or a silicone oil capable of reacting with, or being physically adsorbed by, the silica fine particle.

In the present invention, the preferred method involves chemically treating the silica fine particle, which has been generated by the vapor-phase oxidation of the silicon halide compound, with an organosilicon compound.

Examples of the organosilicon compound include hexamethyldisilazane, trimethylsilane, trimethylchlorosilane, trimethylethoxysilane, dimethyldichlorosilane, methyltrichlorosilane, allyldimethylchlorosilane, allylphenyldichlorosilane, benzyldimethylchlorosilane, bromomethyldimethylchlorosilane, α-chloroethyltrichlorosilane, β-chloroethyltrichlorosilane, chloromethyldimethylchlorosilane, triorganosilylmercaptans, trimethylsilylmercaptan, triorganosilyl acrylates, vinyldimethylacetoxysilane, dimethylethoxysilane, dimethyldimethoxysilane, diphenyldiethoxysilane, hexamethyldisiloxane, 1,3-divinyltetramethyldisiloxane, 1,3-diphenyltetramethyldisiloxane, and dimethylpolysiloxanes having from 2 to 12 siloxane units per molecule and including one hydroxyl group per silicon atom in a unit positioned at the end. These compounds can be used individually or in a mixture of two or more thereof.

In addition, silane coupling agents each having a nitrogen atom, such as aminopropyltrimethoxysilane, aminopropyltriethoxysilane, dimethylaminopropyltrimethoxysilane, diethylaminopropyltrimethoxysilane, dipropylaminopropyltrimethoxysilane, dibutylaminopropyltrimethoxysilane, monobutylaminopropyltrimethoxysilane, dioctylaminopropyldimethoxysilane, dibutylaminopropyldimethoxysilane, dibutylaminopropylmonomethoxysilane, dimethylaminophenyltriethoxysilane, trimethoxysilyl-γ-propylphenylamine, and trimethoxysilyl-γ-propylbenzylamine, may be used individually or in combination.

A preferred example of the silane coupling agent is hexamethyldisilazane (HMDS).

The silicone oil is preferably one having a viscosity of from 0.5 $mm^2/S$ to 10,000 $mm^2/S$, more preferably from 1 $mm^2/S$ to 1000 $mm^2/S$, and still more preferably from 10 $mm^2/S$ to 200 $mm^2/S$ at 25° C. Specific examples thereof include a dimethyl silicone oil, a methyl phenyl silicone oil, an α-methylstyrene-modified silicone oil, a chlorophenyl silicone oil, and a fluorine-modified silicone oil.

Examples of methods for the silicone oil treatment include a method of directly mixing silica fine particles, which have been treated with the abovementioned organosilicon compound and a silane coupling agent, and the silicone oil by using a mixer such as a Henschel mixer; a method of spraying the silica fine particles serving as a base with the silicone oil; and a method of dissolving or dispersing the silicone oil in an appropriate solvent, and then adding and mixing the silica fine particles, followed by the removal of the solvent.

The silica fine particle treated with the silicone oil preferably has a surface coat stabilized by heating the silica fine particle in an inactive gas at 200° C. or more (more preferably 250° C. or more) after the treatment with the silicone oil.

From the standpoint of the ease of obtaining satisfactory hydrophobicity, the treatment amount of the silicone oil is preferably from 1 part by mass to 40 parts by mass, and more preferably from 3 parts by mass to 35 parts by mass with respect to 100 parts by mass of the silica fine particles.

In order to impart satisfactory flowability to the toner, the silica fine particle before being subjected to the hydrophobizing treatment (silica starting material) preferably has a specific surface area measured by a BET method based on nitrogen adsorption of from 200 $m^2/g$ to 350 $m^2/g$.

The specific surface area based on nitrogen adsorption measured by the BET method is measured according to JIS 28830 (2001). As a measuring apparatus, an "Automatic specific surface area/pore distribution-measuring apparatus TriStar 3000 (produced by Shimadzu Corporation)" is used which employs a constant-volume gas adsorption method as a measurement system.

In order to impart flowability and ensure the uniform dispersion state on the toner particle surface, the number-average particle diameter (D1) of the primary particles of the inorganic fine particles B is from 5 nm to 25 nm.

Here, it is preferred that the amount added of the inorganic fine particles B be from 0.1 part by mass to 5.0 part by mass with respect to 100 parts by mass of the toner particles.

When the amount added of the inorganic fine particles B is within the abovementioned range, the total fixing ratio, the inter-particle force, and the ratio of coverage of the toner particle surface by the inorganic fine particles B can be easily controlled.

The ratio of coverage of the toner particle surface by the inorganic fine particles B is preferably from 45.0% to 90.0%, and more preferably from 60.0% to 80.0%.

Where the ratio of coverage by the inorganic fine particles B is from 45.0% to 90.0%, the inter-particle force is easily controlled and the flowability of the toner can be easily increased. The ratio of coverage by the inorganic fine particles B can be adjusted to the abovementioned range by a method of increasing the amount added of the inorganic fine particles B or increasing the total fixing ratio of the inorganic fine particles A and the inorganic fine particles B to the aforementioned toner particle.

In the toner of the present invention, the following external additives can be also used, in addition to the inorganic fine particles A and the inorganic fine particles B, in a small amount to the extent that the effect of the present invention is not affected: lubricants such as fluorine resin powder, zinc stearate powder, and polyvinylidene fluoride powder; and abrasives such as cerium oxide powder, silicon carbide powder, and strontium titanate powder.

An example of the production method of the toner of the present invention is described hereinbelow, but this method is not limiting.

It is preferred that the production method of the toner include a step of adjusting the average circularity exemplified by the below-described surface treatment step, but where other production steps are concerned, the toner can be produced by using a well-known method without any particular limitation.

For example, a binder resin, a colorant, and optional materials such as a wax and a charge control agent are mixed (starting material mixing step). The mixture obtained is melt kneaded (melt kneading step), cooled, and pulverized (pulverization step). The pulverized material thus obtained is subjected, as necessary, to sphering treatment, surface treatment with a hot air current, and classification treatment to provide toner particles. A toner is then produced by externally mixing the inorganic fine particles A and the inorganic fine particles B with the obtained toner particles (the mode of externally adding the inorganic fine particles A and the inorganic fine particles B after the heat sphering treatment; also referred to herein as external addition after heat sphering).

In the abovementioned production method, toner particle are obtained by subjecting, as necessary, the pulverized material obtained in the pulverization step to classification treatment. In another preferred production method, the toner is produced by externally adding the inorganic fine particles A to the obtained toner particles, then performing surface treatment with hot air current, and then externally adding the inorganic fine particles B (the mode of externally adding the inorganic fine particles A before the heat sphering treatment, performing the heat sphering treatment, and then externally adding the inorganic fine particles B; also referred to herein as partial external addition before heat sphering).

The average circularity of the toner is preferably 0.960 or more, and more preferably from 0.965 to 1.000.

As mentioned hereinabove, the average circularity of the toner is easily made 0.960 or more by performing the heat sphering treatment. As a result of the average circularity of the toner being 0.960 or more, the flowability of the toner is likely to increase and the inter-particle force is easily decreased.

From the standpoint of developing performance, the weight-average particle diameter (D4) of the toner is preferably from 5.0 μm to 10.0 μm, and more preferably from 6.0 μm to 9.0 μm.

Further, as a result of performing the heat sphering treatment, the surface composition of the toner particle is easily homogenized. Therefore, the total fixing ratio of the inorganic fine particles A and the inorganic fine particles B can be easily controlled to a predetermined range.

Partial external addition before the heat sphering is preferably used to obtain the total fixing ratio of the inorganic fine particles A and the inorganic fine particles B to the toner particle of 75% or more. As a result of the partial external addition before the heat sphering, the inorganic fine particles A are easily fixed to the toner particle surface. Therefore, fluctuations of the inter-particle force can be suppressed, and the suppression of development ghosts and fogging is further facilitated during a long-term durability use.

Further, in order to ensure the total fixing ratio by the external addition after the heat sphering, the below-described devices may be used for external addition and mixing.

A production example of the toner will be described hereinbelow in greater detail.

In the starting material mixing step of mixing starting materials which are to be supplied to the melt kneading step, a binder resin, a colorant, and optional materials such as a wax and a charge control agent are weighted in predetermined amounts, then blended, and mixed using a mixer. Examples of the mixer include a double-cone mixer, a V-type mixer, a drum mixer, a super mixer, a Henschel mixer, and a Nauta mixer.

The mixed toner starting materials are then melt-kneaded, thereby melting the resins and dispersing the colorant and wax therein. For example, a batch-type kneading machine such as a pressurizing kneader and a Banbury mixer or a continuous kneading machine can be used in the melt kneading step. In recent years, single-screw or twin-screw extruders have been mainly used due to the advantage thereof in enabling continuous production. For example, a KTK-type twin-screw extruder manufactured by Kobe Steel, Ltd., a TEM-type twin-screw extruder manufactured by Toshiba Machine Co., Ltd., a twin-screw extruder manufactured by KCK Co., Ltd., and a co-kneader manufactured by BUSS Corp. are generally used. The resin composition obtained by melt kneading of the toner starting materials is rolled with twin rolls after the melt kneading and then cooled through a cooling step of cooling with cooling water or the like.

The cooled resin composition obtained in the above-described manner is then pulverized to a desired particle diameter in the pulverization step. In the pulverization step, initially coarse pulverization is performed with a crusher, a hammer mill, a feather mill, or the like, and then pulverization is performed with a CRYPTRON SYSTEM manufactured by Kawasaki Heavy Industries, Ltd. or a SUPER ROTOR manufactured by Nisshin Engineering Inc. to obtain a pulverized product.

If necessary, the pulverized product is then classified using a screening machine such as a classifier, for example, ELBOW JET of an inertial classification system (manufactured by Nittetsu Mining Co., Ltd.) and TURBOPLEX of a centrifugal classification system (manufactured by Hosokawa Micron Corporation), thereby providing a classified product.

After the pulverized product has been obtained, for example, surface treatment may be performed with a surface treatment device depicted in FIG. 1, followed by classification treatment and subsequent external addition of the inorganic fine particles A and the inorganic fine particles B.

Alternatively, after the inorganic fine particles A have been externally added to the obtained pulverized product, surface treatment may be performed with the surface treatment device depicted in FIG. 1, followed by classification treatment and subsequent external addition of the inorganic fine particles B.

Also, after the obtained pulverized product has been classified and the inorganic fine particles A have been externally added thereto, surface treatment may be performed with the surface treatment device depicted in FIG. 1, followed by subsequent external addition of the inorganic fine particles B.

A specific example of surface treatment with a hot air current will be explained hereinbelow.

For example, the surface treatment device depicted in FIG. 1 can be used for surface treatment of the resin particles, and the like. Resin particles 1 are fed at a constant rate from an auto-feeder 2 through a feed nozzle 3 into a surface treatment device interior 4. Since suction is performed with a blower 9 in the surface treatment device interior 4, the resin particles 1 introduced from the feed nozzle 3 are dispersed in the device.

The resin particles 1 dispersed in the device are instantaneously heated and surface treated by a hot air current discharged from a hot air current introducing port 5. In the present invention, the hot air current is generated by a heater, but the generation means is not particularly limited, provided that the hot air current sufficient for surface treating the resin particles is generated. Surface-treated resin particles 7 are instantaneously cooled by a cold air current discharged from a cold air current introducing port 6. In the present invention, liquid nitrogen is used for the cold air current, but the cooling means is not particularly limited, provided that the surface-treated resin particles 7 can be instantaneously cooled. The surface-treated resin particles 7 are sucked in by a blower 9 and collected in a cyclone 8.

In the surface treatment, the hot air current discharged from the hot air current introducing port 5 is at a temperature of from 160° C. to 450° C. Where the hot air current temperature is 160° C. or higher, the average circularity of the toner can be easily increased. Further, where the hot air current temperature is 450° C. or less, the coalescence of the resin particles can be easily suppressed.

Further, if necessary, surface modification and sphering treatment may be further performed using, for example, a hybridization system produced by Nara Machinery Co., Ltd. and a mechano-fusion system produced by Hosokawa Micron Corporation. In this case, a sieving machine such as a Hi-Bolter (produced by Shin-Tokyo Kabushiki Kaisha) which is a sieve of a blow-through type may be used, as necessary.

Then, the inorganic fine particles may be externally mixed with the toner particles by compounding the toner particles and inorganic fine particles in predetermined amounts and stirring and mixing by using as an external addition machine a high-speed stirrer providing shear stress to the powder, such as a Henschel mixer and a super mixer.

A specific example of a method for externally adding the inorganic fine particles will be described below, but this method is not intended to be limiting.

Figure 2:
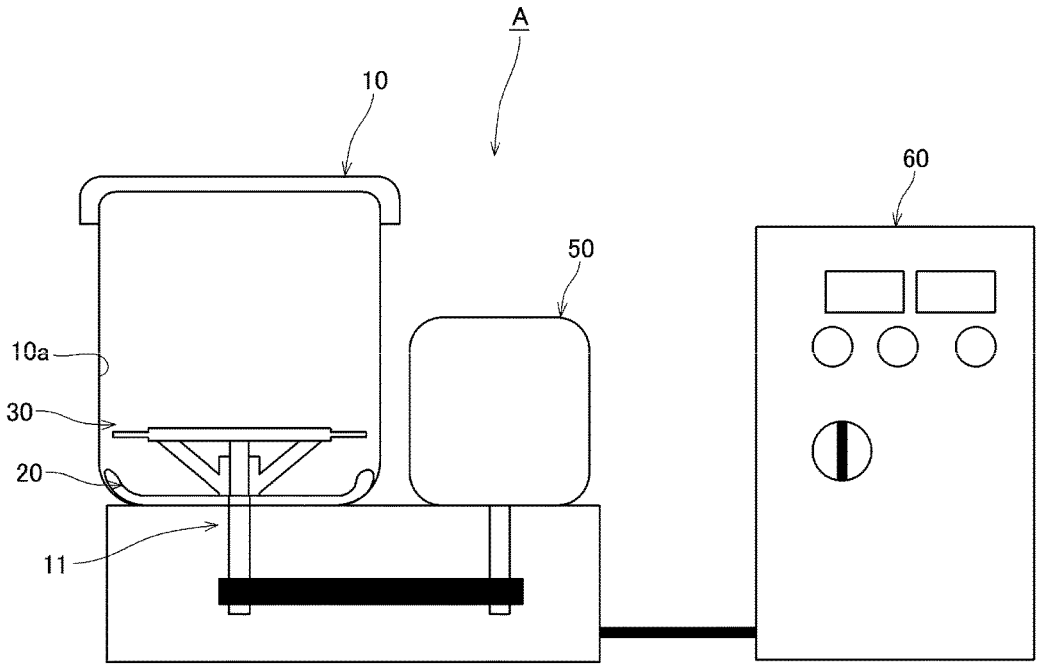
FIG. 2 is an outline diagram of a toner treatment device.

A toner treatment device depicted in FIG. 2 is preferred as a device for externally adding the inorganic fine particles A by external addition after the heat sphering. The toner treatment device depicted in FIG. 2 will be described hereinbelow in detail.

[Toner Treatment Device]

A toner treatment device A is configured of a treatment chamber (treatment tank) 10, a stirring impeller 20 as lifting means, a rotary body 30, a drive motor 50, and a control unit 60. The treatment chamber 10 serves to accommodate a material to be treated which includes the toner particles and inorganic fine particles. The stirring impeller 20 is provided rotatably in the bottom portion of the treatment chamber 10 so as to be below the rotary body 30 inside the treatment chamber. Further, the rotary body 30 is provided rotatably above the stirring impeller 20.

[Treatment Chamber]

Figure 3:
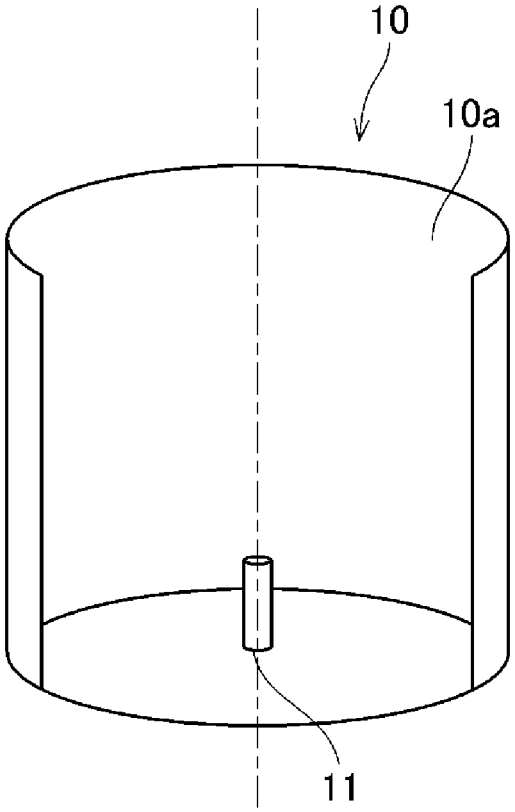
FIG. 3 is an outline diagram of a treatment chamber.

FIG. 3 shows a schematic diagram of the treatment chamber 10. In FIG. 3, an inner peripheral surface (inner wall) 10*a* of the treatment chamber 10 is partially cut out for convenience of explanation.

The treatment chamber 10 is a cylindrical container having a substantially flat bottom portion and is provided with a drive shaft 11 for mounting the stirring impeller 20 and the rotary body 30 substantially in the center of the bottom portion.

From the standpoint of strength, it is preferred that the treatment chamber 10 be made of a metal such as iron and SUS, and it is preferred that an electrically conductive material be used for the inner surface, or that the inner surface be processed to impart electric conductivity thereto.

[Lifting Means]

Figure 4A:
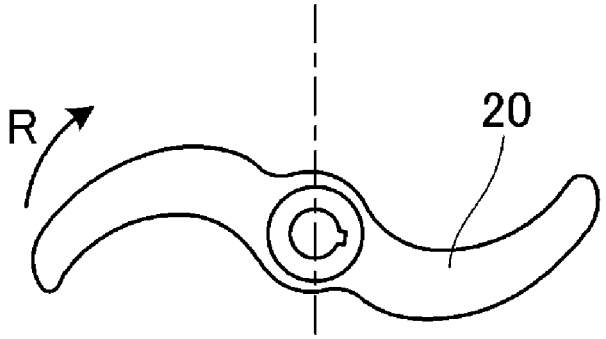
FIGS. 4A and 4B are top and side views of a stirring impeller.
Figure 4B:
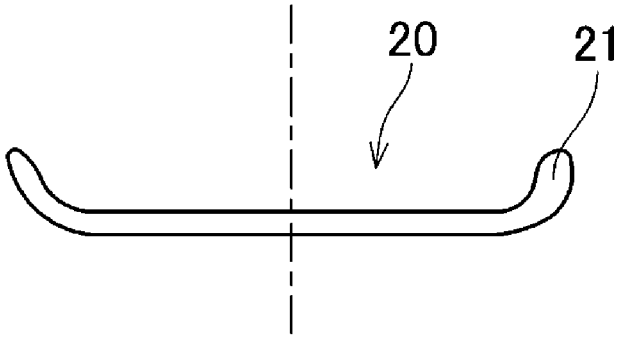

FIG. 4 shows a schematic diagram of the stirring impeller 20 as the lifting means. FIG. 4A is a top view, and FIG. 4B is a side view. The stirring impeller 20 is configured to be capable of lifting by rotation the material to be treated which includes the toner particles and the inorganic fine particles inside the treatment chamber 10. The stirring impeller 20 has an impeller portion 21 which extends outward (to the outside in the radial direction (radially outward)) from the rotation center, and the tip of the impeller portion 21 has a flip-up shape so as to lift the material to be treated.

The shape of the impeller portion 21 can be appropriately designed according to the size and operation conditions of the toner treatment device A and the filled amount and specific gravity of the material to be treated. From the standpoint of strength, it is preferred that the stirring impeller 20 be made from a metal such as iron and SUS, and the stirring impeller may be plated or coated, as necessary, to impart wear resistance thereto. The stirring impeller 20 is fixed to the drive shaft 11 in the bottom portion of the treatment chamber 10 and rotated clockwise, when viewed from above (state depicted in FIG. 4A). In the figure, the rotation direction of the drive shaft 11 is shown by an arrow R. Due to the rotation of the stirring impeller 20, the material to be treated rises, while rotating in the same direction as the stirring impeller 20 inside the treatment chamber 10, and soon falls under gravity. The material to be treated is thus uniformly mixed.

[Rotary Body]

Figure 5A:
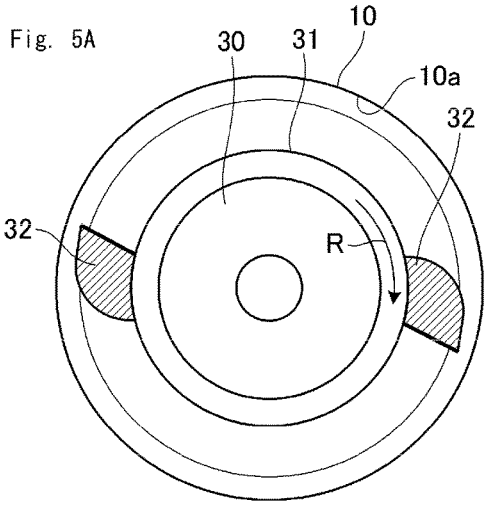
FIG. 5A is a top view illustrating a rotary body.
Figure 5B:
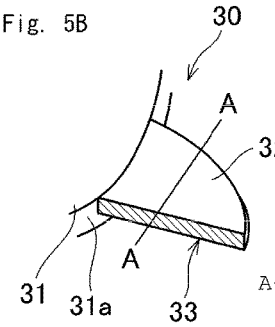
FIG. 5B is a perspective view illustrating a principal portion.
Figure 5C:
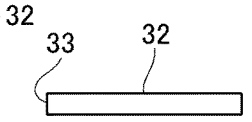
FIG. 5C is a cross-sectional view.

FIGS. 5 and 6 show schematic diagrams of the rotary body 30. FIG. 5A is a top view illustrating the rotary body 30 disposed inside the treatment chamber 10. FIG. 5B is a perspective principal view of the rotary body 30. FIG. 5(*c*) shows an A-A sectional view taken in FIG. 5B.

Figure 6A:
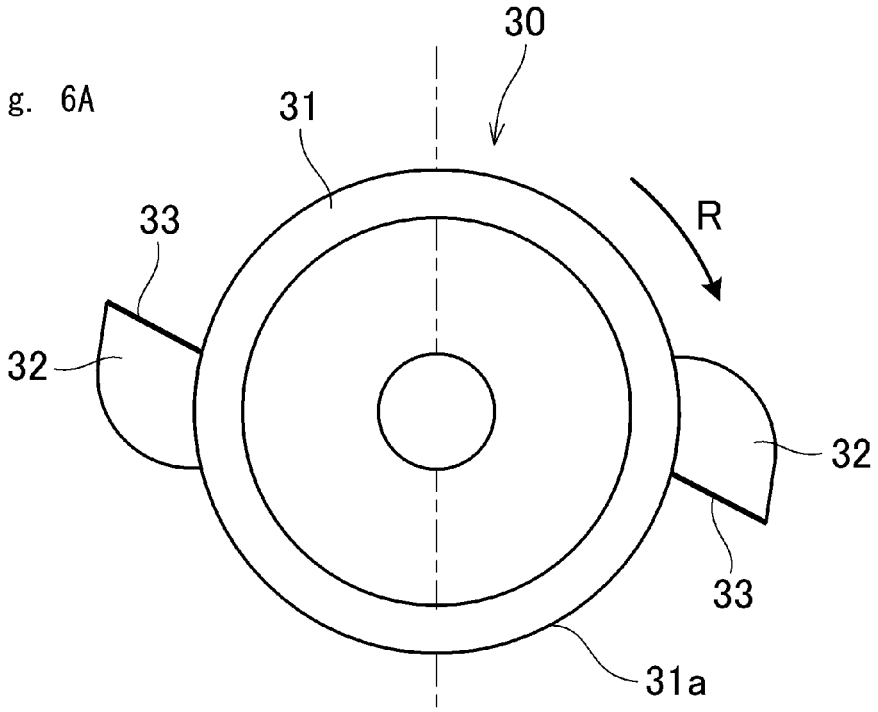
FIGS. 6A and 6B are top and side views of the rotary body.
Figure 6B:
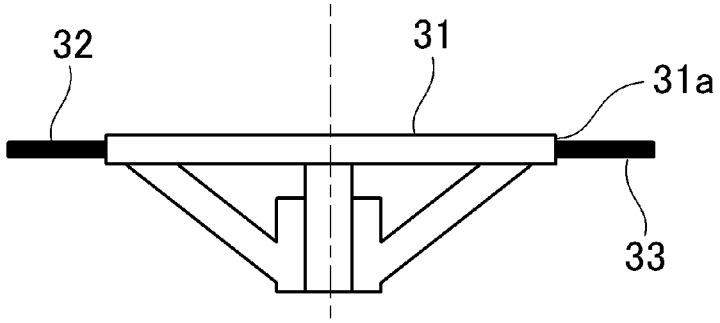

FIG. 6A is a top view of the rotary body 30. FIG. 6B is a side view thereof. The rotary body 30 is fixed to the same drive shaft 11 as the stirring impeller 20 above the stirring impeller 20 inside the treatment chamber 10 and rotates in the same direction as the stirring impeller 20 (direction of the arrow R).

The rotary body 30 is configured of a rotary body main portion 31 and a treatment portion 32 provided with a treatment surface 33 that collides with the material to be treated and treats the material to be treated due to the rotation of the rotary body 30. The treatment surface 33 extends radially outward from an outer peripheral surface 31*a* of the rotary body main portion 31 and is formed such that a region of the treatment surface 33 which is farther from the rotary body main portion 31 is located downstream in the rotation direction of the rotary body 30 with respect to a region which is closer than this region to the rotary body main portion 31.

The inorganic fine particles are externally added and can be coated on or fixed to the toner particles as a result of collision between the material to be treated and the treatment surface 33 induced by the rotation of the rotary body 30.

Figure 7:
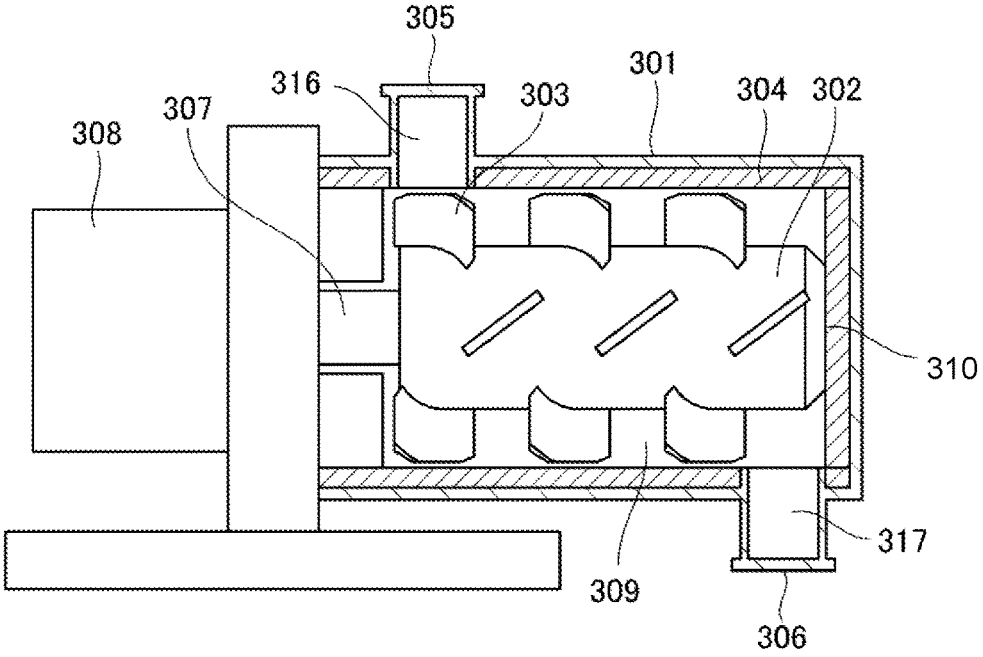
FIG. 7 is a schematic diagram illustrating an example of a mixing treatment device.

Meanwhile, concerning the external addition of the inorganic fine particles B, from the standpoint of enabling easy control of the coverage ratio and diffusion state, it is preferred that mixing be performed using a device such as depicted in FIG. 7. FIG. 7 is a schematic diagram illustrating an example of a mixing treatment device that can be used, for example, when externally mixing the inorganic fine particles B.

Since this mixing treatment device is configured such that the toner particles and inorganic fine particles B are subjected to shear in a narrow clearance portion, the inorganic fine particles B can be attached to the surface of the toner particles, while loosening from secondary particles into primary particles. Further, as will be described hereinbelow, since the toner particles and inorganic fine particles B are likely to circulate in the axial direction of the rotary body and be mixed sufficiently uniformly before the attachment is advanced, the ratio of coverage with the inorganic fine particles B can be easily controlled to the preferred range of the present invention.

Figure 8:
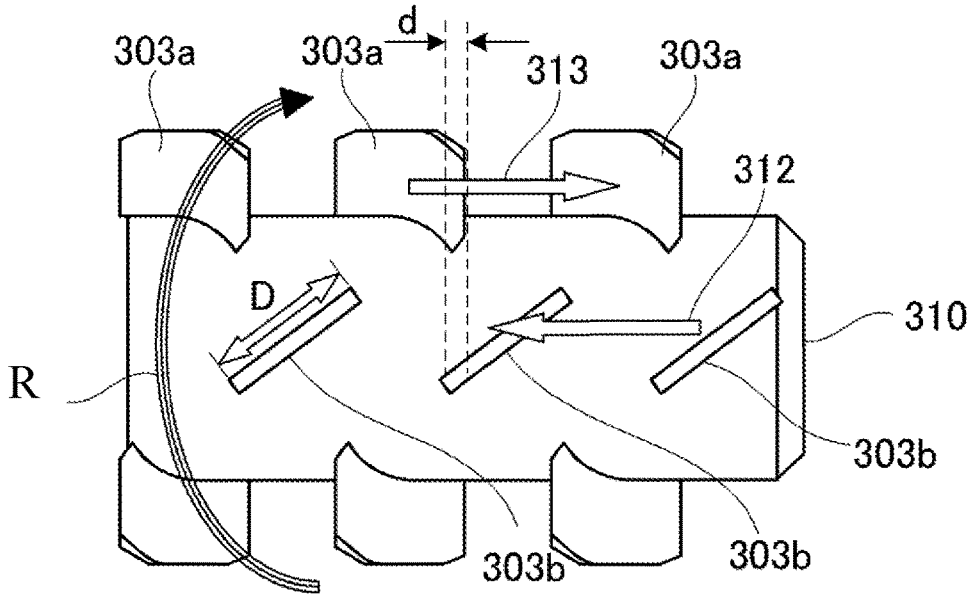
FIG. 8 is a schematic diagram illustrating an example of the configuration of a stirring member to be used in the mixing treatment device.

Meanwhile, FIG. 8 is a schematic diagram illustrating an example of the configuration of a stirring member to be used in the mixing treatment device.

One mode of the step of externally adding the inorganic fine particles B will be explained hereinbelow by using FIGS. 7 and 8. The mixing treatment device for externally adding the inorganic fine particles B has at least a rotary body 302 in which a plurality of stirring members 303 is disposed at the surface, a drive unit 308 that rotationally drives the rotary body, and a main body casing 301 provided with a gap from the stirring members 303.

A constant and very small gap (clearance) may be provided between the inner peripheral portion of the main body casing 301 and the stirring member 303 in order to impart uniform shear to the toner particles and facilitate the attachment of the inorganic fine particles B to the toner particles, while loosening the secondary particles of the inorganic fine particles into primary particles.

Further, in this device, the diameter of the inner peripheral portion of the main body casing 301 is not more than twice as large as the diameter of the outer peripheral portion of the rotary body 302. In the example depicted in FIG. 7, the diameter of the inner peripheral portion of the main body casing 301 is 1.7 times the diameter of the outer peripheral portion of the rotary body 302 (the diameter of the body obtained by removing the stirring member 303 from the rotary body 302). Where the diameter of the inner peripheral portion of the main body casing 301 is not more than twice as large as the diameter of the outer peripheral portion of the rotary body 302, the treatment space where a force acts upon the toner particles is suitably limited. Therefore, a sufficient impact force is applied to the inorganic fine particles B which are in the form of secondary particles.

Further, the clearance may be adjusted according to the size of the main body casing. Setting the clearance to from about 1% to about 5% of the diameter of the inner peripheral portion of the main body casing 301 is adequate in terms of applying sufficient shear to the inorganic fine particles. More specifically, when the diameter of the inner peripheral portion of the main body casing 301 is about 130 mm, the clearance may be set to from about 2 mm to about 5 mm, and when the diameter of the inner peripheral portion of the main body casing 301 is 800 mm, the clearance may set to from about 10 mm to about 30 mm.

In the external mixing step of the inorganic fine particles B in the present invention, the mixing treatment device is used, the rotary body 302 is rotated by the drive unit 308, and the toner particles and the inorganic fine particles B loaded into the mixing treatment device are stirred and mixed, thereby treating the surface of the toner particles by external mixing with the inorganic fine particles B.

As depicted in FIG. 8, at least some of the plurality of the stirring members 303 are formed as feeding stirring members 303*a* that feed the toner particles and the inorganic fine particles B in one direction in the axial direction of the rotary body as the rotary body 302 rotates. Further, at least some of the plurality of the stirring members 303 are formed as returning stirring members 303*b* that return the toner particles and the inorganic fine particles B in the other direction in the axial direction of the rotary body as the rotary body 302 rotates.

In this case, where a raw material load port 305 and a product discharge port 306 are provided at the two ends of the main body casing 301, as depicted in FIG. 7, the direction from the raw material load port 305 toward the product discharge port 306 (rightward direction in FIG. 7) will be referred to as "feed direction".

Thus, the plate surface of the feeding stirring member 303*a* is inclined, as depicted in FIG. 8, so as to feed the toner particles and the inorganic fine particles B in the feed direction (313). Meanwhile, the plate surface of the returning stirring member 303*b* is inclined so as to feed the toner particles and the inorganic fine particles B in the return direction (312). As a result, the surface of the toner particles is treated by external mixing with the inorganic fine particles B while the feed in the "feed direction" (313) and the feed in the "return direction" (312) are repeatedly performed.

Further, the stirring members 303*a* and 303*b* are configured as sets of a plurality of members arranged at intervals in the circumferential direction of the rotary body 302. In the example depicted in FIG. 8, the stirring members 303*a* and 303*b* are configured as sets of two members at 180-degree intervals at the rotary body 302, but the stirring members may be also configured as sets of a larger number of members, for example, 3 members at 120-degree intervals or 4 members at 90-degree intervals. In the example depicted in FIG. 8, a total of 12 stirring members 303*a* and 303*b* are formed equidistantly.

Further, in FIG. 8, D is the width of the stirring member and d is an interval representing the overlapping portion of the stirring members. From the standpoint of efficiently feeding the toner particles and the inorganic fine particles B in the feed direction and return direction, it is preferred that D be a width of from about 20% to about 30% of the length of the rotary body 302 in FIG. 8. FIG. 8 shows an example in which the width is 23%. It is also preferred that the stirring members 303*a* and 303*b* have a certain overlapping portion d of the stirring member 303*b* and the stirring member 303*a*, when an extension line is drawn from the end position of the stirring member 303*a* in the perpendicular direction.

As a result, shear can be efficiently applied to the inorganic fine particles B which are in the form of secondary particles. From the standpoint of shear application, it is preferred that d constitute from 10% to 30% of D.

As for the shape of the impeller, in addition to the shape depicted in FIG. 8, the impeller may have a curved surface, provided that the toner particles can be fed in the feed direction and return direction and the clearance can be maintained, or may have a paddle structure in which a distal-end impeller portion is joined by a rod-shaped arm to the rotary body 302.

The present invention will be explained hereinbelow in greater detail with reference to the schematic diagrams of the device depicted in FIGS. 7 and 8.

The device depicted in FIG. 7 has at least the rotary body 302 on the surface of which the plurality of the stirring members 303 is arranged, the drive unit 308 that rotationally drives the rotary body 302, and the main body casing 301 provided with a gap from the stirring members 303. Further, a jacket 304 that enables the flow of cooling-heating medium is provided at the inner side of the main body casing 301 and a rotary body end side surface 310.

The device depicted in FIG. 7 also has the raw material load port 305 formed in the upper portion of the main body casing 301 and the product discharge port 306 formed in the lower portion of the main body casing 301. The raw material load port 305 is used for introducing the toner particles and inorganic fine particles B, and the product discharge port 306 is used for discharging the toner treated by external mixing to the outside from the main body casing 301.

Further, in the device depicted in FIG. 7, an inner piece 316 for the raw material load port is inserted in the raw material load port 305, and an inner piece 317 for the product discharge port is inserted in the product discharge port 306.

In the present invention, initially, the inner piece 316 for the raw material load port is taken out from the raw material load port 305, and the toner particles are loaded from the raw material load port 305 into a treatment space 309. Then, the inorganic fine particles B are loaded from the raw material load port 305 into a treatment space 309, and the inner piece 316 for the raw material load port is inserted. Then, the rotary body 302 is rotated by the drive unit 308, and the loaded treatment material is subjected to external mixing treatment while being stirred and mixed by the plurality of the stirring members 303 provided on the surface of the rotary body 302.

The sequence of loading may be changed such that the inorganic fine particles B are initially loaded from the raw material load port 305, and the toner particles are then loaded from the raw material load port 305. Further, it is also possible to mix the toner particles and the inorganic fine particles B in advance with a mixing device such as a Henschel mixer, and then load the mixture from the raw material load port 305 of the device depicted in FIG. 7.

As external mixing treatment conditions, from the standpoint of obtaining the total fixing ratio of the inorganic fine particles A and the inorganic fine particles B and the ratio of coverage with the inorganic fine particles B, which are preferred in the present invention, it is preferred that the power of the drive unit 308 be controlled to from 0.2 W/g to 2.0 W/g. It is more preferred that the power of the drive unit 308 be controlled to from 0.6 W/g to 1.6 W/g.

Where the power is 0.2 W/g or more, the total fixing ratio of the inorganic fine particles A and the inorganic fine particles B and the ratio of coverage with the inorganic fine particles B are unlikely to decrease. Meanwhile, where the power is 2.0 W/g or less, the inorganic fine particles B cannot be embedded too much.

The treatment time is not particularly limited and is preferably from 3 min to 10 min.

The revolution speed of the stirring members during the external mixing is not particularly limited. In the device with a volume of the treatment space 309 of $2.0\times10^{-3}$ $m^3$, which is depicted in FIG. 7, the revolution speed of the stirring member in the direction R in the case where the stirring member 303 has the shape depicted in FIG. 8 is preferably from 800 rpm to 3000 rpm.

After completion of the external mixing treatment, the inner piece 317 for the product discharge port located in the product discharge port 306 is taken out therefrom, the rotary body 302 is rotated by the drive unit 308, and the toner is discharged from the product discharge port 306. Coarse particles, and the like, contained in the obtained toner are separated, as necessary, with a sieve such as a circular vibration sieve to obtain the resulting toner.

The image forming apparatus of the present invention has an electrostatic latent image bearing member, a contact type charging roller that electrically charges the electrostatic latent image bearing member, image exposure means for forming an electrostatic latent image on the surface of the electrically charged electrostatic latent image bearing member, development means for developing the electrostatic latent image with a toner and forming a toner image, transfer means for transferring the toner image onto a transfer material via an intermediate transfer body or without the intermediate transfer body, and fixing means for fixing the toner image, which has been transferred onto the transfer material, to the transfer material, the image forming apparatus including no cleaning means for removing residual toner downstream of the transfer means and upstream of the contact type charging roller, and the residual toner being recovered by the development means, wherein the toner is the toner of the present invention.

The image forming method of the present invention includes a charging step of charging the surface of an electrostatic latent image bearing member by using a contact type charging roller, an electrostatic latent image forming step of exposing the electrically charged surface of the electrostatic latent image bearing member and forming an electrostatic latent image, a development step of developing the electrostatic latent image with a toner and forming a toner image, a transfer step of transferring the toner image onto a transfer material via an intermediate transfer body or without the intermediate transfer body, and a fixing step of fixing the toner image, which has been transferred onto the transfer material, to the transfer material, the image forming method including no cleaning step of removing residual toner between the transfer step and the charging step, and the residual toner being recovered by the development means, wherein the toner is the toner of the present invention.

The image forming apparatus and image forming method which are used in the present invention will be explained hereinbelow in greater detail with reference to the drawings, but the present invention is not limited thereto.

Figure 9:
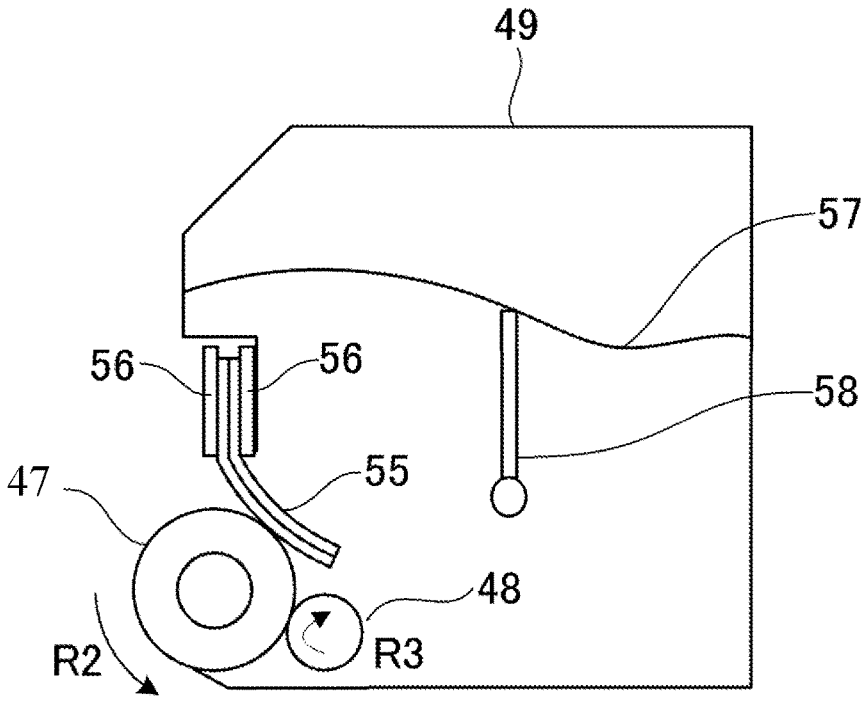
FIG. 9 is a schematic sectional view illustrating an example of a development device.

FIG. 9 is a schematic cross-sectional view illustrating an example of the developing device. Further, FIG. 10 is a schematic cross-sectional view illustrating an example of the image forming apparatus incorporating the developing device of the present invention.

Figure 10:
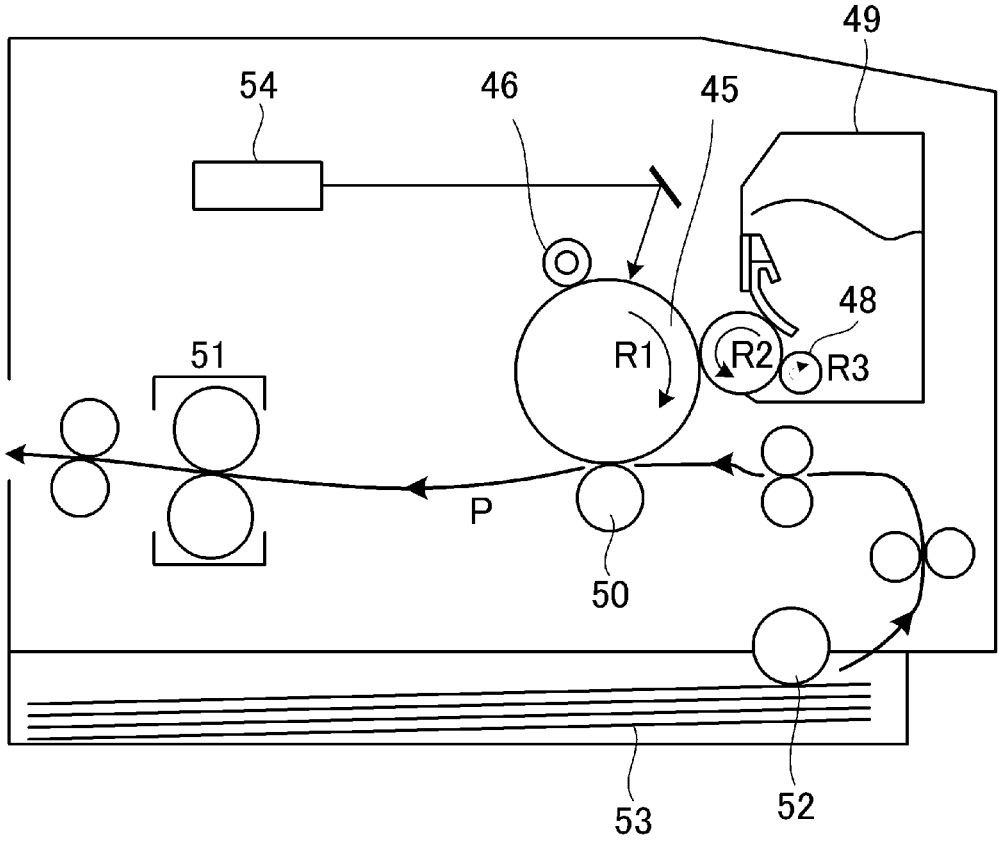
FIG. 10 is a schematic sectional view illustrating an example of an image forming apparatus.

In FIGS. 9 and 10, an electrostatic latent image bearing member 45 is rotated in the direction of an arrow R1. A toner carrying member 47 rotates in the direction of an arrow R2, thereby transporting a toner 57 to a development region where the toner carrying member 47 and the electrostatic latent image bearing member 45 face each other. A toner feed member 48 rotates in the direction of an arrow R3, while being in contact with the toner carrying member, and feeds the toner 57 to the toner carrying member surface. Further, the toner 57 is stirred by a stirring member 58.

A charging roller 46, a transfer member (transfer roller) 50, a fixing device 51, and a pick-up roller 52, etc. are provided around the electrostatic latent image bearing member 45. The electrostatic latent image bearing member 45 is charged by the charging roller 46. Exposure is then performed by irradiating the electrostatic latent image bearing member 45 with laser light from a laser generator 54, and an electrostatic latent image corresponding to the target image is formed. The electrostatic latent image on the electrostatic latent image bearing member 45 is developed with the toner in the developing device 49 and a toner image is obtained. The toner image is transferred onto a transfer material (paper) 53 with the transfer member (transfer roller) 50 that is brought into contact with the electrostatic latent image bearing member 45, with the transfer material being interposed therebetween. The transfer material (paper) 53 carrying the toner image is moved to the fixing device 51 and fixed on the transfer material (paper) 53.

In the charging step in the image forming apparatus, a contact charging device is used in which the electrostatic latent image bearing member and the charging roller are brought into contact to form a contact region, a predetermined charging bias is applied to the charging roller, and the electrostatic latent image bearing member is charged to predetermined polarity and electric potential. As a result of performing such contact charging, it is possible to perform stable uniform charging and reduce the generation of ozone.

Further, in order to maintain uniform contact with the electrostatic latent image bearing member and perform uniform charging, it is preferred that the charging roller be used that rotates in the same direction as the electrostatic latent image bearing member.

The preferred process conditions when using the contact type charging roller can be exemplified by a contact pressure of the charging roller of from 4.9 N/m to 490.0 N/m and a DC voltage or an AC voltage superimposed on a DC voltage.

An AC voltage of from 0.5 kVpp to 5.0 kVpp, an AC frequency of from 50 Hz to 5 kHz, and a DC voltage with an absolute value of from 400 V to 1700 V are preferred.

As materials of the contact type charging roller, examples of materials of the elastic body include rubber materials in which an electrically conductive substance such as carbon black or metal oxide is dispersed for resistance adjustment in ethylene-propylene-diene polyethylene (EPDM), urethane, butadiene-acrylonitrile rubber (NBR), silicone rubber, and isoprene rubber, or these rubber materials subjected to foaming, but these examples are not limiting. The resistance can be also adjusted by using an ion-conductive material, without dispersing the electrically conductive substance, or together with an electrically conductive substance.

Further, aluminum and stainless steel are examples of core metals to be used in the contact type charging roller. The contact type charging roller is provided to be pressed against a body to be charged, which is the electrostatic latent image bearing member, by a predetermined pressing force and forms a charging contact region which is the contact region of the charging roller and the electrostatic latent image bearing member.

The contact transfer step which is preferably used in the image forming apparatus will be specifically explained hereinbelow.

In the contact transfer step, a toner image is electrostatically transferred on a recording medium, while the electrostatic latent image bearing member is brought into contact, through the recording medium, with the transfer member to which a voltage of a polarity opposite that of the toner has been applied.

The contact pressure of the transfer member is preferably a linear pressure of 2.9 N/m or more, and more preferably 19.6 N/m or more. Where the linear pressure as the contact pressure is 2.9 N/m or more, a shift upon transport of the recording medium and transfer defects is unlikely to occur.

In the present invention, it is preferred that the thickness of the toner layer on the toner carrying member be regulated by bringing a toner regulating member (reference numeral 55 in FIG. 9) into contact with the toner carrying member, with the toner being interposed therebetween. As a result, high image quality which is free of fogging can be obtained. A regulating blade is typically used and can be also advantageously used in the present invention as the toner regulating member that is in contact with the toner carrying member.

A rubber elastic body from silicone rubber, urethane rubber, or NBR; a synthetic resin elastic body such as polyethylene terephthalate; or a metal elastic body from a phosphorus bronze sheet or stainless steel sheet can be used as the regulating blade, and composites of these materials may be also used. Further, members obtained by attaching a charge control substance such as a resin, rubber, metal oxide, metal with the object of controlling the charging ability of the toner to an elastic support body such as a rubber, synthetic resin, and metal elastic body, so that the charge control substance touches the toner carrying member contact region, may be also used. Among them, a member in which a resin or rubber is pasted on a metal elastic body so as to touch the toner carrying member contact region is particularly preferred.

A material that is likely to be charged to a positive potential, such as urethane rubber, urethane resin, polyamide resin, and nylon resin is preferred for the member to be pasted on the metal elastic body.

A base portion which is the upper-side portion of the regulating blade is fixedly held on the developing device side, and the lower-side portion is brought into contact by an appropriate elastic pressing force with the toner carrying member surface in a state of being bent in a forward or reverse direction of the toner carrying member against the elastic force of the blade.

For example, the toner regulating member 55 may be fixed to the developing device as depicted in FIG. 9 by clamping one free end of the toner regulating member 55 between two fixing members (for example, metal elastic bodies, denoted by the reference symbol 56 in FIG. 9) and fixing with a screw.

The effective contact pressure of the regulating blade and toner carrying member, as a linear pressure in the generating line direction of the toner carrying member, is preferably from 1.30 N/m to 245.0 N/m, and more preferably from 4.9 N/m to 118.0 N/m. By adjusting the contact pressure to this range, it is possible to ensure uniform coating of the toner and to prevent the toner from degradation.

Further, the amount of the toner layer on the toner carrying member is preferably from 2.0 $g/m^2$ to 15.0 $g/m^2$, and more preferably from 3.0 $g/m^2$ to 14.0 $g/m^2$. By adjusting the toner amount on the toner carrying member to this range, it is possible to ensure sufficient image density and prevent regulation defects.

Incidentally, the toner amount on the toner carrying member can be controlled, as desired, by changing the surface roughness (Ra) of the toner carrying member, the free length of the regulating blade, and the contact pressure of the regulating blade.

Further, the toner amount on the toner carrying member is measured by mounting circular filtration paper on a suction port with an outer diameter of 6.5 mm. This is attached to a vacuum cleaner, the toner on the toner carrying member is sucked in, and the toner amount on the toner carrying member is taken as a value obtained by dividing the sucked-in toner amount (g) by the suction surface area ($m^2$).

The outer diameter of the toner carrying member is preferably from 8.0 mm to 14.0 mm.

In terms of increasing the compactness of the developing device, a smaller outer diameter of the toner carrying member is preferred, but as the outer diameter is decreased, the developing performance is likely to degrade and development ghosts tend to appear. For this reason, in the toner carrying member and toner used in the present invention the outer diameter of the toner carrying member is preferably from 8.0 mm to 14.0 mm to ensure both the compactness and the development ghost suppression.

Further, the surface roughness of the toner carrying member is preferably in a range from 0.3 μm to 5.0 μm, and more preferably from 0.5 μm to 4.5 μm, when measured as a central line average roughness Ra according to the surface roughness standard JIS B 0601:1994. Where Ra is in the abovementioned range, a sufficient toner transport amount is obtained, the regulation of the toner amount on the toner carrying member is facilitated, regulation defects are unlikely to occur, and a uniform charge quantity of the toner is likely to be obtained.

The central line average roughness Ra according to the surface roughness standard JIS B 0601:1994 on the toner carrying member surface is measured using SURFCODER SE-3500 produced by Kosaka Laboratory Ltd.

The measurements are performed under the measurement conditions of a cut-off of 0.8 mm, an evaluation length of 4 mm, and a feed range of 0.5 mm/s in 9 points (three points in the circumferential direction for each of three points arranged equidistantly in the axial direction) and taking an average value.

The surface roughness of the toner carrying member can be set in the abovementioned range, for example, by changing the polishing state of the surface layer of the toner carrying member or by adding spherical carbon particles, carbon microparticles, graphite, resin microparticles, and the like.

The development step is preferably a step of applying a developing bias to the toner carrying member and transferring the toner to the electrostatic latent image on the electrostatic latent image bearing member to form the toner image. The developing bias which is to be applied may be a DC voltage or a voltage obtained by superimposing an alternating electric field on a DC voltage.

The waveform of the alternating electric field can be selected, as appropriate, from a sine wave, rectangular wave, triangular wave, and the like. It may also be a pulse wave formed by periodically ON/OFF switching a DC power source. Thus, a bias such that the voltage value thereof changes periodically can be used as the waveform of the alternating electric field.

Figure 11:
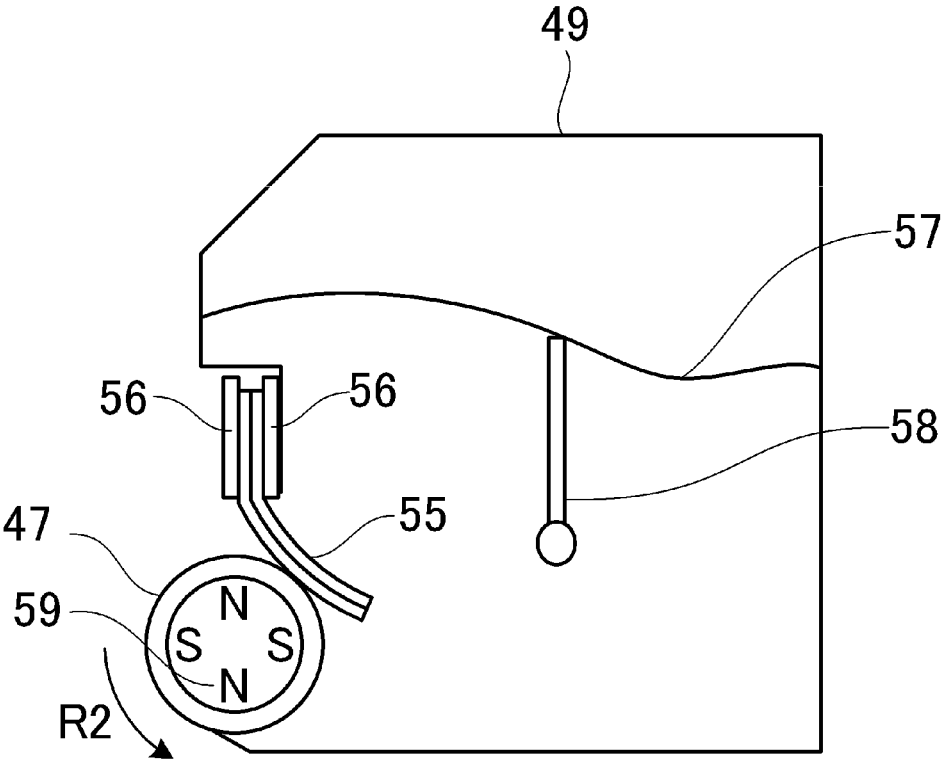
FIG. 11 is a schematic sectional view illustrating another example of a development device.

Further, when a system is used in which the toner is transported magnetically without using a toner feed member, a magnet (reference numeral 59 in FIG. 11) may be disposed inside the toner carrying member. In this case, it is preferred that a magnet having multiple poles be fixed inside the toner carrying member, and the number of magnetic poles is preferably from 3 to 10.

Methods for measuring physical properties in the present invention will be described hereinbelow.

<Method for Measuring Number-Average Particle Diameter (D1) of Primary Particles of Inorganic Fine Particles A and the Inorganic Fine Particles B>

The number-average particle diameter of primary particles of the inorganic fine particles A and the inorganic fine particles B is determined by observing the inorganic fine particles A and the inorganic fine particles B present on a toner particle surface with a scanning electron microscope. A Hitachi ultra-high-resolution field-emission scanning electron microscope S-4800 (produced by Hitachi, Ltd.) is used as the scanning electron microscope. The image capturing conditions of S-4800 are described below. Initially, elemental analysis is performed with an energy-dispersive X-ray analyzer (produced by EDAX of AMETEK Co., Ltd.), and the measurements are performed after confirming that each particle is a silica fine particle, a titanium oxide fine particle, or an alumina fine particle.

(1) Sample Preparation

An electrically conductive paste is thinly coated on a sample stage (aluminum sample stage measuring 15 mm×6 mm) and a toner is sprayed thereon. Air is then blown to remove an excess toner from the sample stage and ensure sufficient drying. The sample stage is set in a sample holder, and the height of the sample stage is adjusted to 36 mm by a sample height gauge.

(2) Setting of S-4800 Observation Conditions.

The number-average particle diameter of the primary particles of the inorganic fine particles A (silica fine particles) and inorganic fine particles B (silica fine particles, titanium oxide fine particles, or alumina fine particles) is calculated using an image obtained by backscattered electron image observation with S-4800. Since the charge-up of the inorganic fine particles with the backscattered electron image is less than that with a secondary electron image, the particle diameter of the inorganic fine particles can be measured with good accuracy.

Liquid nitrogen is injected, to the point of overflowing, into an anti-contamination trap attached to the housing of S-4800 and allowed to stand for 30 min. "PCSTEM" of S-4800 is booted up, and flushing (cleaning of an FE chip which is an electron source) is performed. An accelerating voltage indicator on the control panel on the screen is clicked, the "FLUSHING" button is pressed, and the flushing execution dialog is opened.

Flushing is executed upon confirming a flushing intensity of 2. It is confirmed that the emission current created by flushing is from 20 μA to 40 μA. The sample holder is inserted into the sample chamber of the housing of S-4800.

A "START POINT" on the control panel is pressed to move the sample holder to the observation position.

The accelerating voltage indicator is clicked, the HV setting dialog is opened, the accelerating voltage is set to "0.8 kV", and the emission current is set to "20 μA". In the "BASIC" tab of the operation panel, signal selection is set to "SE", then "UP (U)" and "+BSE" are selected for the SE detector, "L. A. 100" is selected in the selection box to the right of "+BSE", and a mode for backscattered electron image observation is set.

Likewise, in the "BASIC" tab in the operation panel, the probe current in the Electron Optics System Conditions block is set to "Normal", the focus mode is set to "UHR", and WD is set to "3.0 mm". The "ON" button of the accelerating voltage indicator in the control panel is pressed, and the accelerating voltage is applied.

(3) Calculation of Number-Average Particle Diameter (D1) of Inorganic Fine Particles A The magnification indicator in the control panel is dragged and the magnification is set to 100,000× (100 k). The focus knob "COARSE" in the operation panel is rotated and the adjustment of aperture alignment is performed when the image is in focus to a certain degree. "Align" in the control panel is clicked to display the alignment dialog, and "BEAM" is selected. Then, the STIGMA/ALIGNMENT knobs (X, Y) in the operation panel are rotated to move the displayed beam to the center of the concentric circles.

Next, "APERTURE" is selected, the STIGMA/ALIGNMENT knobs (X, Y) are turned one at a time and alignment is performed to stop or minimize image movement. The aperture dialog is closed, and focusing is performed by autofocus. This operation is repeated two more times to adjust the focus.

Then, silica fine particles with a diameter of from 50 nm to 250 nm are considered to be the inorganic fine particles A, and silica fine particles, titanium oxide fine particles, or alumina fine particles with a diameter of 49 nm or less are considered to be the inorganic fine particles B. The particle diameter is measured with respect to at least 300 inorganic fine particles A and at least 300 inorganic fine particles B on the surfaces of the toner particle, and the average particle diameter thereof is determined. Due to the external addition method, the inorganic fine particles A and the inorganic fine particles B can be also present as aggregated lumps. Therefore, the maximum diameter of the particles which can be confirmed to be primary particles is determined and the number-average particle diameter (D1) of the primary particles of the inorganic fine particles A and the inorganic fine particles B is obtained by arithmetic averaging of the maximum diameters thus obtained.

<Method for Measuring Weight-Average Particle Diameter (D4) of Toner>

The weight-average particle diameter (D4) is calculated by using a precision particle size distribution measuring device "Coulter Counter Multisizer 3" (registered trade name, produced by Beckman Coulter Inc.) based on a pore electrical resistance method and including a 100 μm aperture tube and dedicated software "Beckman-Coulter Multisizer 3 Version 3.51" (produced by Beckman Coulter Inc.) included therewith for setting measurement conditions and performing analysis of measurement data, performing measurements at a number of effective measurement channels of 25,000, and analyzing the measurement data.

A solution obtained by dissolving reagent grade sodium chloride in ion-exchanged water to a concentration of about 1 mass %, for example, "ISOTON II" (produced by Beckman Coulter Inc.) can be used as the aqueous electrolytic solution to be used in the measurement.

The dedicated software is set as described hereinbelow before the measurement and analysis are performed.

In the "STANDARD MEASUREMENT METHOD (SOM) CHANGE SCREEN" of the dedicated software, the total count number of a control mode is set to 50,000 particles, the number of measurement cycles is set to 1, and a value obtained using "STANDARD PARTICLES 10.0 μm" (produced by Beckman Coulter Inc.) is set as a Kd value. A threshold and a noise level are set automatically by pressing the threshold/noise level measurement button. Further, a current is set to 1600 μA, a gain is set to 2, an electrolytic solution is set to ISOTON II, and a check mark is placed in "FLUSH OF APERTURE TUBE AFTER MEASUREMENT" check box.

In the "PULSE-TO-PARTICLE DIAMETER CONVERSION SETTING SCREEN" of the dedicated software, a bin interval is set to a logarithmic particle diameter, the number of particle diameter bins is set to 256, and the particle diameter range is set to a range from 2 μm to 60 μm.

A specific measurement method is described below.

(1) About 200 ml of the aqueous electrolytic solution is poured into a 250-mL round-bottom beaker designed specifically for Multisizer 3. The beaker is set in a sample stand, and the electrolytic solution is stirred with a stirrer rod at 24 rev/sec in a counterclockwise direction. Then, dirt and air bubbles in the aperture tube are removed by the "APERTURE FLUSH" function of the dedicated software.

(2) About 30 mL of the aqueous electrolytic solution is poured into a 100-mL flat-bottom beaker. Then, about 0.3 mL of a diluted solution prepared by diluting "Contaminon N" (a 10 mass % aqueous solution of a neutral detergent for washing precision measuring devices; contains a nonionic surfactant, an anionic surfactant, and an organic builder, and has a pH of 7; produced by Wako Pure Chemical Industries, Ltd.) with ion-exchanged water by a factor of 3 in terms of mass is added as a dispersant to the aqueous electrolytic solution.

(3) A predetermined amount of ion-exchanged water is poured into the water tank of an ultrasonic dispersing unit "Ultrasonic Dispersion System Tetora 150" (produced by Nikkaki Bios Co., Ltd.) which has an electrical output of 120 W and in which two oscillators having an oscillating frequency of 50 kHz are installed with a phase shift of 180 degrees, and about 2 mL of the Contaminon N is added into the water tank.

(4) The beaker in clause (2) above is set in the beaker fixing hole of the ultrasonic dispersing unit, and the ultrasonic dispersing unit is operated. Then, the height position of the beaker is adjusted to realize a maximum resonant state of the liquid level of the aqueous electrolytic solution in the beaker.

(5) About 10 mg of the toner is added by small portions and dispersed in the aqueous electrolytic solution in the beaker of clause (4) above while irradiating the aqueous electrolytic solution with ultrasonic waves. Then, the ultrasonic dispersion treatment is further continued for 60 seconds. During the ultrasonic dispersion, the temperature of water in the water tank is appropriately adjusted to be in the range from 10° C. to 40° C.

(6) The aqueous electrolytic solution of clause (5) above, in which the toner has been dispersed, is added dropwise with a pipette into the round-bottom beaker of clause (1) above which has been placed in the sample stand, and the measurement concentration is adjusted to about 5%. Measurements are performed up to a number of measured particles of 50,000.

(7) The measured data are analyzed with the dedicated software included with the apparatus, and the weight-average particle diameter (D4) is calculated. The "ARITHMETIC DIAMETER" on the analysis/volume statistics (arithmetic average) screen when the dedicated software is set to graph/vol % is the weight-average particle diameter (D4).

<Method for Measuring Half Width of Maximum Peak in Particle Size Distribution of Primary Particles of Inorganic Fine Particles A>

The half width of the maximum peak in the particle size distribution of primary particles of the inorganic fine particles A is measured using a disc centrifugal particle size distribution-measuring apparatus "DC24000" produced by CPS Instruments Inc. The measurement method is described below.

(A) In the Case of Magnetic Toner

First, 0.5 mg of Triton-X100 (produced by Kishida Chemical Co., Ltd.) is added to 100 g of ion-exchanged water to prepare a dispersion medium. Then, 1 g of the toner is added to 9 g of the dispersion medium and dispersed for 5 mins with the ultrasonic dispersing unit. After that, a neodymium magnet is used to bind the toner particles and prepare a supernatant.

Next, a syringe needle designed specifically for the measuring apparatus (produced by CPS Instruments Inc.) is attached to the tip of All-Plastic Disposable Syringe (produced by TGK) having attached thereto a syringe filter (diameter: 13 mm/pore diameter: 0.45 μm) (produced by Advantec Toyo Kaisha, Ltd.), and 0.1 mL of the supernatant is collected.

The supernatant collected with the syringe is injected into the disc centrifugal particle size distribution-measuring apparatus DC24000, and the half width of the maximum peak in the particle size distribution of primary particles of the inorganic fine particles A is measured.

Details of the measurement method are as described below.

First, the disc of the apparatus is rotated at 24,000 rpm with Motor Control in CPS software. After that, the following conditions are set in Procedure Definitions.

(1) Sample Parameter

Maximum Diameter: 0.5 μm
Minimum Diameter: 0.05 μm
Particle Density: from 2.0 g/mL to 2.2 g/mL (appropriately adjusted depending on a sample)
Particle Refractive Index: 1.43
Particle Absorption: 0 K
Non-Sphericity Factor: 1.1

(2) Calibration Standard Parameters

Peak Diameter: 0.226 μm
Half Height Peak Width: 0.1 μm
Particle Density: 1.389 g/mL
Fluid Density: 1.059 g/mL
Fluid Refractive Index: 1.369
Fluid Viscosity: 1.1 cps After the above-mentioned conditions have been set, an automated gradient maker AG300 produced by CPS Instruments Inc. is used to prepare a density gradient solution formed of a 8 mass % sucrose aqueous solution and a 24 mass % sucrose aqueous solution, and 15 mL of the density gradient solution is injected into a measurement container.

After the injection, in order to prevent the evaporation of the density gradient solution, 1.0 mL of dodecane (produced by Kishida Chemical Co., Ltd.) is injected to form an oil film, followed by a wait of 30 mins or more for stabilizing the apparatus.

After the wait, standard particles for calibration (weight-based median particle diameter: 0.226 μm) are injected with a 0.1-mL syringe into the measuring apparatus, and calibration is performed. After that, the abovementioned collected supernatant is injected into the apparatus, a particle size distribution is measured, and a half width is measured from the obtained distribution data.

Figure 12:
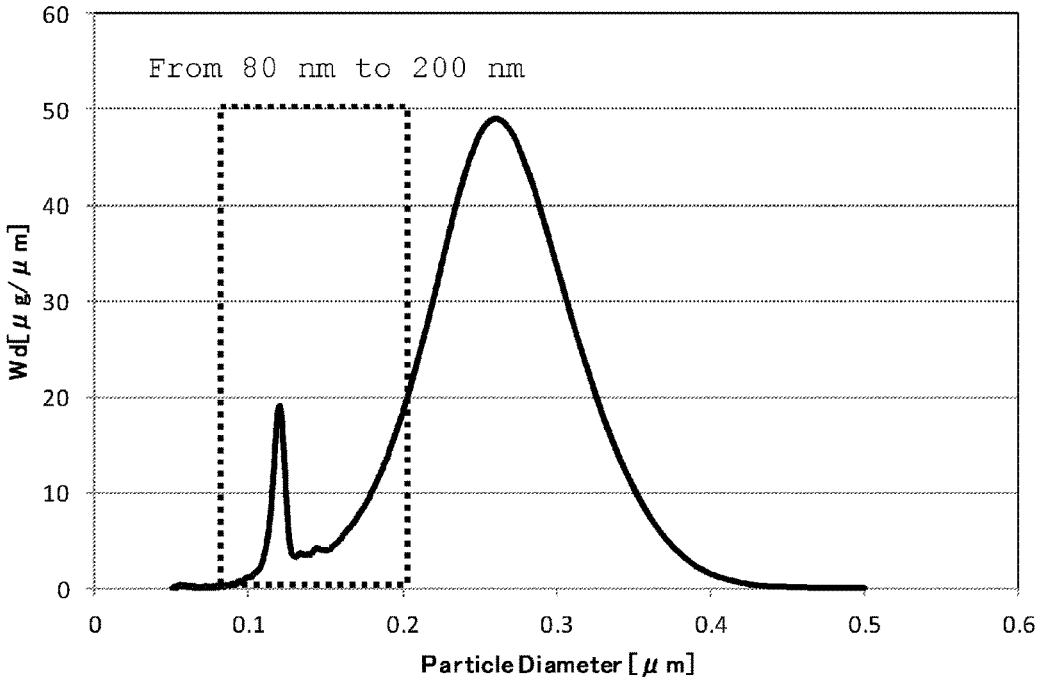
FIG. 12 is an example of measurement data on the half width obtained for the inorganic fine particle A.

An example of the distribution data obtained in actual measurement is shown in FIG. 12.

As depicted in FIG. 12, the distribution data are obtained as a graph in which "PARTICLE DIAMETER" is plotted against the abscissa, and "VALUE OBTAINED BY DIVIDING MASS BY PARTICLE DIAMETER" is plotted against the ordinate. The half width of the maximum peak obtained in 80 nm to 200 nm in the graph is taken as the half width of the maximum peak in the particle size distribution of primary particles of the inorganic fine particles A.

(B) In the Case of Non-Magnetic Toner

First, 0.5 mg of Triton-X100 (produced by Kishida Chemical Co., Ltd.) is added to 100 g of ion-exchanged water to prepare a dispersion medium. Then, 0.6 g of the toner is added to 9.4 g of the dispersion medium, and dispersed for 5 mins with the ultrasonic dispersing unit. Next, a syringe needle designed specifically for the measuring apparatus (produced by CPS Instruments Inc.) is attached to the tip of All-Plastic Disposable Syringe (produced by TGK.) having attached thereto a syringe filter (diameter: 13 mm/pore diameter: 0.45 μm) (produced by Advantec Toyo Kaisha, Ltd.), and 0.1 mL of the supernatant is collected. The supernatant collected with the syringe is injected into the disc centrifugal particle size distribution-measuring apparatus DC24000, and the half width of the maximum peak in the particle size distribution of primary particles of the inorganic fine particles A is measured.

Details of the measurement method are the same as in "In the Case of Magnetic Toner" hereinabove.

<Method for Measuring Average Circularity of Toner >

The average circularity of the toner is measured under measurement and analysis conditions at the time of a calibration operation with a flow-type particle image analyzer "FPIA-3000" (produced by Sysmex Corporation).

A specific measurement method is as described below.

First, about 20 ml of ion-exchanged water from which solid impurities have been removed in advance is poured into a glass vessel.

Then, about 0.2 mL of a diluted solution prepared by diluting "Contaminon N" (a 10 mass % aqueous solution of a neutral detergent for washing precision measuring devices; contains a nonionic surfactant, an anionic surfactant, and an organic builder, and has a pH of 7; produced by Wako Pure Chemical Industries, Ltd.) with ion-exchange water by a factor of 3 in terms of mass is added as a dispersant to the vessel.

Further, about 0.02 g of a measurement sample is added to the vessel, and the dispersion treatment is performed for 2 mins with the ultrasonic dispersing unit to obtain a dispersion solution for measurement. At that time, the dispersion solution is appropriately cooled so as to have a temperature of from 10° C. to 40° C.

A desktop ultrasonic cleaning and dispersing unit having an oscillation frequency of 50 kHz and an electrical output of 150 W (for example, "VS-150" (produced by VELVOCLEAR)) is used as the ultrasonic dispersing unit. A predetermined amount of ion-exchanged water is poured into a water tank, and about 2 mL of the Contaminon N is added to the water tank. The flow-type particle image analyzer provided with "LUCPLFLN" (magnification: 20, numerical aperture: 0.40) as an objective lens is used in the measurement, and a particle sheath "PSE-900A" (produced by Sysmex Corporation) is used as a sheath liquid. The dispersion solution prepared in accordance with this procedure is introduced into the flow-type particle image analyzer, and 2,000 toner particles are subjected to measurement according to the total count mode of an HPF measurement mode. Then, the average circularity of the toner is determined with a binarization threshold at the time of particle analysis set to 85% and particles to be analyzed limited to ones with a circle-equivalent diameter of from 1.977 μm to 39.54 μm.

In the measurement, automatic focus adjustment is performed with standard latex particles (obtained by diluting, for example, "RESEARCH AND TEST PARTICLES Latex Microsphere Suspensions 5100A", produced by Duke Scientific Corporation, with ion-exchanged water) before the measurement is started. After that, focusing is preferably performed every two hours from the start of the measurement.

In the Examples, a flow-type particle image analyzer which has been subjected to a calibration operation by Sysmex Corporation and has received a calibration certificate issued by Sysmex Corporation is used. The measurement is performed under measurement and analysis conditions identical to those at the time of the reception of the calibration certificate except that particles to be analyzed are limited to ones with a circle-equivalent diameter of 1.977 μm or more and less than 39.54 μm.

<Method for Measuring Ratio of Coverage of Toner Particle Surface with Inorganic Fine Particles B>

The ratio of coverage of the toner particle surface with the inorganic fine particles B is calculated by analyzing the toner particle surface image, which has been captured with the Hitachi ultra-high-resolution field-emission scanning electron microscope S-4800 (produced by Hitachi High-Technologies Corporation), with image analysis software Image-Pro Plus ver. 5.0 (Nippon Roper K. K.) of S-4800. The image capturing conditions are described below.

(1) Sample Preparation

An electrically conductive paste is thinly coated on a sample stage (aluminum sample stage measuring 15 mm×6 mm) and a toner is sprayed thereon. Air is then blown to remove an excess toner from the sample stage and ensure sufficient drying. The sample stage is set in a sample holder, and the height of the sample stage is adjusted to 36 mm by a sample height gauge.

(2) Setting of S-4800 Observation Conditions

The coverage ratio is calculated using an image obtained by backscattered electron image observation with S-4800. Since the charge-up of the inorganic fine particles with the backscattered electron image is less than that with a secondary electron image, the coverage ratio can be measured with good accuracy.

Liquid nitrogen is injected, to the point of overflowing, into an anti-contamination trap attached to the housing of S-4800 and allowed to stand for 30 min. "PC-SEM" of S-4800 is booted up, and flushing (cleaning of an FE chip which is an electron source) is performed. An accelerating voltage indicator on the control panel on the screen is clicked, the "FLUSHING" button is pressed, and the flushing execution dialog is opened. Flushing is executed upon confirming a flushing intensity of 2. It is confirmed that the emission current created by flushing is from 20 μA to 40 μA. The sample holder is inserted into the sample chamber of the housing of S-4800. A "START POINT" on the control panel is pressed to move the sample holder to the observation position.

The accelerating voltage indicator is clicked, the HV setting dialog is opened, the accelerating voltage is set to "0.8 kV", and the emission current is set to "20 μA". In the "BASIC" tab of the operation panel, signal selection is set to "SE", then "UP (U)" and "+BSE" are selected for the SE detector, "L. A. 100" is selected in the selection box to the right of "+BSE", and a mode for backscattered electron image observation is set. Likewise, in the "BASIC" tab in the operation panel, the probe current in the Electron Optics System Conditions block is set to "Normal", the focus mode is set to "UHR", and WD is set to "3.0 mm". The "ON" button of the accelerating voltage indicator in the control panel is pressed, and the accelerating voltage is applied.

(3) Calculation of Number-Average Particle Diameter (D1) of Toner

The magnification indicator in the control panel is dragged and the magnification is set to 5000× (5 k). The focus knob "COARSE" in the operation panel is rotated and the adjustment of aperture alignment is performed when the image is in focus to a certain degree. "Align" in the control panel is clicked to display the alignment dialog, and "BEAM" is selected. Then, the STIGMA/ALIGNMENT knobs (X, Y) in the operation panel are rotated to move the displayed beam to the center of the concentric circles.

Next, "APERTURE" is selected, the STIGMA/ALIGNMENT knobs (X, Y) are turned one at a time and alignment is performed to stop or minimize image movement. The aperture dialog is closed, and focusing is performed by autofocus. This operation is repeated two more times to adjust the focus.

Then, the number-average particle diameter (D1) is determined by measuring the particle diameter for 300 toner particles. The particle diameter of individual particles is a maximum diameter when the toner particle is observed.

(4) Focus Adjustment

The magnification indicator in the control panel is dragged and the magnification is set to 10,000× (10 k) in a state in which the central point of the maximum diameter is aligned with the center of the measurement screen for the particles with a diameter that is ±0.1 μm of the number-average particle diameter (D1) obtained in clause (3). The focus knob "COARSE" in the operation panel is rotated and the adjustment of aperture alignment is performed when the image is in focus to a certain degree. "Align" in the control panel is clicked to display the alignment dialog, and "BEAM" is selected. Then, the STIGMA/ALIGNMENT knobs (X, Y) in the operation panel are rotated to move the displayed beam to the center of the concentric circles. Next, "APERTURE" is selected, the STIGMA/ALIGNMENT knobs (X, Y) are turned one at a time and alignment is performed to stop or minimize image movement. The aperture dialog is closed, and focusing is performed by autofocus. This operation is repeated two more times to adjust the focus. The magnification is then set to 50000× (50 k), focus adjustment is performed by using the focus knob and STIGMA/ALIGNMENT knobs in the same manner as described above, and focusing is again performed by autofocus. This operation is repeated two times to adjust the focus. In this case, where the inclination angle of the observation surface is large, the measurement accuracy of the coverage ratio is likely to decrease. Therefore, the configuration without any surface inclination is selected and analyzed by selecting the mode in which the entire observation surface is focused at the same time when focus adjustment is performed.

(5) Saving of Images

Brightness adjustment is performed in an ABC mode, and an image of a size of 1280×960 pixels is photographed and saved. The following analysis is performed using the image file. One photograph is taken with respect to one toner particles, and an image is obtained for at least 30 toner particles.

(6) Image Analysis

In the present invention, the image obtained by the above-described method is binarized by the below-described analysis software to calculate a coverage ratio. In this case, the abovementioned one screen is divided into 12 squares and each square is analyzed. However, it is assumed that where an inorganic fine particle with a size of 50 nm or more enters the divided segment, the coverage ratio is not calculated for this segment. Inorganic fine particles with a size of 49 nm or less are taken to be inorganic fine particles B, and the ratio of coverage of the toner particle surface is assumed to be by the inorganic fine particles B.

The analysis conditions for image analysis software Image-Pro Plus ver. 5.0 are presented below.

Software Image-Pro Plus 5.1J

The "Measurement" on the toolbar is opened and then "Count/Size" and then "Options" are selected to set binarization conditions. In the object extraction options, 8-Connect is checked and Smoothing is set to 0. In addition, "Pre-Sorting", "Fill Holes", and "Enclosing Line" are unchecked, and "Remove Boundary Lines" is set at "None". From "Measurement" on the toolbar, "Measurements Items" are selected and 2 to $10^7$ is inputted in Sorting Ranges of Area.

The coverage ratio is calculated by encircling and analyzing a square region. In this case, the area (C) of the region is set so as to have from 24,000 to 26,000 pixels. Then, automatic binarization is selected in "Process"-binarization and the total area (D) of the regions in which the inorganic fine particles B are not present is calculated.

The coverage ratio for the inorganic fine particles B is determined by the following formula from the area C of the square region and the total area (D) of the regions in which the inorganic fine particles B are not present.

Coverage ratio (%) for inorganic fine particles $$B=100-(D/C\times 100)$$

As described above, the coverage ratio is calculated with respect to 30 or more toner particles. An average value of all data obtained is taken as the coverage ratio (%) for inorganic fine particles B in the present invention.

<Method for Measuring Inter-Particle Force of Toner>

The inter-particle force of the toner is measured using AGGROBOT produced by Hosokawa Micron Corporation.

A specific measurement method is as described below.

(1) In the Case of Magnetic Toner

Figure 13A:
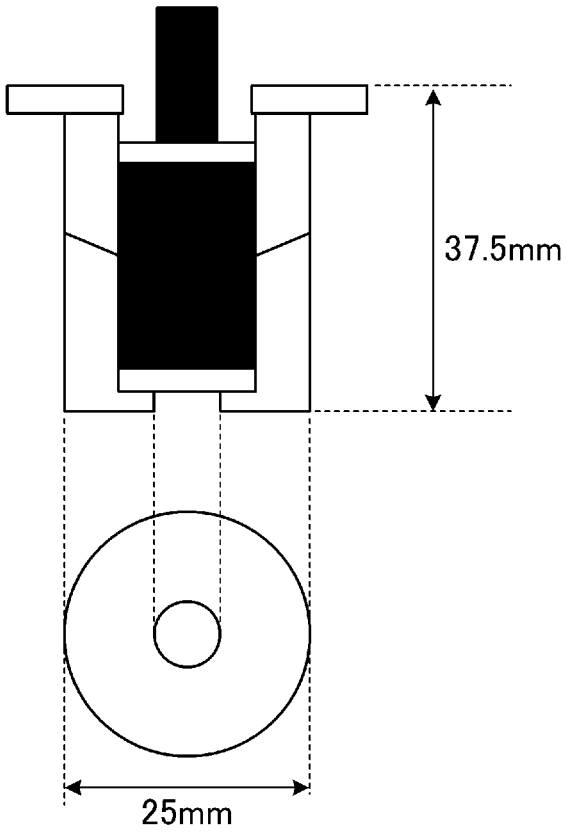
FIGS. 13A and 13B illustrate a device for measuring an inter-particle force.

Under a 25° C./50% environment, 9.2 g of the toner is loaded into a vertically bisected cylindrical cell depicted in FIG. 13A. After that, a compression rod is lowered at 0.1 mm/sec to apply a vertical load of from 78.5 N or 157.0 N, thereby forming a consolidated toner layer.

Figure 13B:
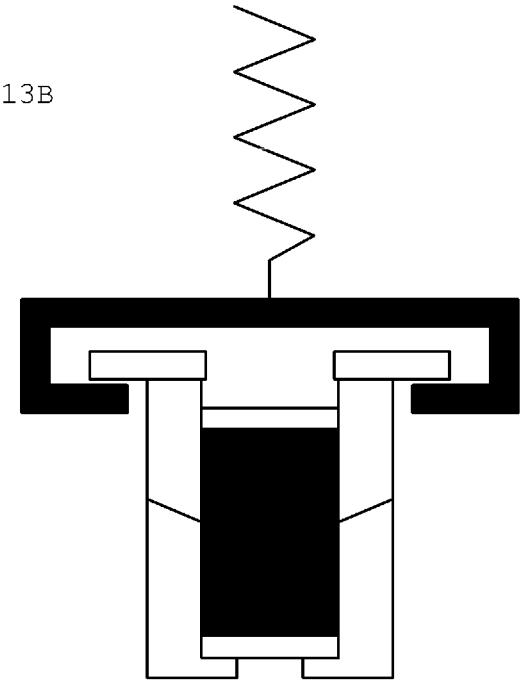

Then, as depicted in FIG. 13B, the upper cell is lifted with a spring at a speed of 0.4 mm/sec to pull the toner layer, and an inter-particle force is calculated based on the maximum tensile fracture force at the time the toner layer is fractured.

The cylindrical cell has an inner diameter of 25 mm and a height of 37.5 mm.

(2) In the Case of Non-Magnetic Toner

Under a 25° C./50% environment, 7.7 g of the toner is loaded into a vertically bisected cylindrical cell depicted in FIG. 13A. After that, a compression rod is lowered at 0.1 mm/sec to apply a vertical load of 78.5 N or 157.0 N, thereby forming a consolidated toner layer.

Then, as depicted in FIG. 13B, the upper cell is lifted with a spring at a speed of 0.4 mm/sec to pull the toner layer, and an inter-particle force is calculated based on the maximum tensile fracture force at the time the toner layer is fractured.

The cylindrical cell has an inner diameter of 25 mm and a height of 37.5 mm.

<Measurement of Total Fixing Ratio of Inorganic Fine Particles A and Inorganic Fine Particles B>

(1) Sample Preparation

Toner before washing: Various toners prepared in Examples below were used directly.

Toner after washing: 20 g of "Contaminon N" (a 2 mass % aqueous solution of a neutral detergent for washing precision measuring devices; contains a nonionic surfactant, an anionic surfactant, and an organic builder, and has a pH of 7; produced by Wako Pure Chemical Industries, Ltd.) is weighed into a 50 mL vial and mixed with 1 g of toner. The vial is set in "KM Shaker" (model: V. SX) produced by Iwaki Industry Co., Ltd., and shaken for 30 seconds at a speed set to 50. Then, the toner is separated from the aqueous solution by using a centrifuge (5 min at 1000 rpm). The supernatant is separated, and the precipitated toner is vacuum dried into a solid state.

External additive-free toner: the external additive-free toner means a toner in a state after a releasable external additive has been removed in this test. In the method for sample preparation, a toner is added to a solvent, such as isopropanol, which does not dissolve the toner, and shaken for 10 mins in an ultrasonic washing machine. Then, the toner is separated from the solution by using a centrifuge (5 min at 1000 rpm). The supernatant is separated, and the precipitated toner is vacuum dried into a solid state.

(2) Measurement of Total Fixing Ratio

With respect to the toner before washing, toner after washing, and external additive-free toner, the inorganic fine particles A and the inorganic fine particles B are quantified and the degree of their release is determined by measuring the intensity for each element derived from the inorganic fine particles A and the inorganic fine particles B by using wavelength-dispersive fluorescent X-ray analysis (XRF).

(i) Example of Apparatus Used

Fluorescent X-ray analysis apparatus 3080 (Rigaku Corporation).

Sample press molding machine MAEKAWA Testing Machine (produced by MFG Co., Ltd.).

(ii) Measurement Conditions

Electric potential and voltage for measurement: 50 kV, from 50 mA to 70 mA

2θ angle: a

Crystal plate: LiF

Measurement time: 60 sec (iii) Method for Calculating Total Fixing Ratio to Toner Particle First, the intensity of the elements derived from the inorganic fine particles A and the inorganic fine particles B is determined for the toner before washing, toner after washing, and external additive-free toner by the above-described method. Then, the total fixing ratio of the inorganic fine particles A and the inorganic fine particles B to the toner particle is calculated on the basis of the formula below. When silica fine particles are used as the inorganic fine particles A and the inorganic fine particles B, the total fixing ratio may be calculated on the basis of the following formula with respect to the silicon element. When titanium oxide fine particles and alumina fine particles are used as the inorganic fine particles B, the fixing ratio is calculated by the following formula with respect to each of silicon, titanium, and aluminum and the total fixing ratio is calculated by adding up the values obtained.

Total fixing ratio of inorganic fine particles *A* and inorganic fine particles *B*=[(Intensity of each element derived from inorganic fine particles *A* and inorganic fine particles *B* in toner after washing)−(Intensity of each element derived from inorganic fine particles *A* and inorganic fine particles *B* in external additive-free toner)]/[(Intensity of each element derived from inorganic fine particles *A* and inorganic fine particles *B* in toner before washing)−(Intensity of each element derived from inorganic fine particles *A* and inorganic fine particles *B* in external additive-free toner)]×100. [Formula]

EXAMPLES

The present invention is described hereinbelow more specifically by way of Examples. However, the present invention is by no means limited to the Examples. In the Examples, "part(s)" and "%" refer to "part(s) by mass" and "mass %", unless specifically stated otherwise.

<Production of Toner Carrying Member 1>

(Preparation of Substrate)

A substrate was produced by coating a primer (trade name, DY35-051; produced by Toray Dow Corning Corporation) on a polished aluminum cylindrical tube with an outer diameter of 10 mm (diameter) and a central line average roughness Ra of 0.2 μm and then calcining.

(Production of Elastic Roller)

The substrate was arranged in a metal mold, and an addition-type silicone rubber composition obtained by mixing the following materials was injected into the cavity formed inside the metal mold.

| | |
|---|---|
| Liquid silicone rubber material (tradename, SE6724A/B; produced by Toray Dow Corning Corporation). | 100.0 parts |
| Carbon black (tradename, TOKABLACK #4300, produced by Tokai Carbon Co., Ltd.) | 15.0 parts |
| Silica powder as a heat resistance imparting agent | 0.2 part |
| Platinum catalyst | 0.1 part |

The metal mold was then heated and the addition-type silicone rubber composition was vulcanized and cured for 15 min at a temperature of 150° C. The substrate in which a cured silicone rubber layer was formed on the peripheral surface was removed from the metal mold and further heated for 1 h at a temperature of 180° C. to complete the curing reaction of the silicone rubber layer. An elastic roller with a diameter of 11 mm was thus produced in which a silicone rubber elastic layer with a thickness of 0.5 mm was formed on the outer periphery of the substrate.

(Synthesis of Isocyanate Group-Terminated Prepolymer)

Under a nitrogen atmosphere, 100.0 g of a polypropylene glycol-based polyol (trade name: EXCENOL 4030; produced by Asahi Glass Co., Ltd.) was gradually added dropwise to 17.7 parts of tolylene diisocyanate (TDI) (trade name: COSMONATE T80; produced by Mitsui Chemicals, Inc.), in a reaction vessel, while the temperature in the reaction vessel was kept at 65° C. After completion of the dropwise addition, a reaction was carried out for 2 h at a temperature of 65° C. The resulting reaction mixture was cooled to room temperature to provide an isocyanate group-terminated prepolymer having an isocyanate group content of 3.8 mass %.

(Synthesis of Amine Compound)

In a reaction vessel equipped with a stirring device, a thermometer, a dropping device, and a temperature-adjusting device, 100.0 parts (0.97 mol part) of diethylenetriamine and 100 parts of ethanol were warmed to 40° C. under stirring. Next, 235.0 parts (5.34 mol parts) of ethylene oxide was gradually added dropwise over 30 mins while the reaction temperature was kept at 60° C. or less. A reaction was further carried out for 1 h under stirring to provide a reaction mixture. The resulting reaction mixture was heated under reduced pressure to distill off ethanol, thereby providing an amino compound.

(Production of Surface Layer)

As materials for a surface layer, 33.2 parts of the amino compound, 117.4 parts of carbon black (trade name, MA230; produced by Mitsubishi Chemical Corporation), and 130.4 parts of urethane resin fine particles (trade name, Art Pearl C-400; produced by Negami Chemical Industrial Co., Ltd.) were stirred and mixed with 618.9 parts of the isocyanate group-terminated prepolymer.

Next, methyl ethyl ketone (MEK) was added to obtain a total solid content ratio of 30 mass %, thereby preparing a coating material for forming a surface layer.

Then, the portion of the elastic roller produced in advance where the silicone rubber layer was not present was masked, and the roller was placed in a vertical position and rotated at 1500 rpm. The coating material was applied thereto while lowering a spray gun at 30 mm/s. The coated layer was then cured and dried by heating for 20 min at a temperature of 180° C. in a hot air current drying furnace, thereby providing a surface layer having a thickness of about 8 μm on the outer periphery of the silicone rubber elastic layer. A toner carrying member 1 was thus produced.

<Production of Inorganic Fine Particles A>

(Manufacturing Example of Inorganic Fine Particles A-1)

Inorganic fine particles A-1 were produced by a sol-gel method.

A total of 687.9 g of methanol, 42.0 g of pure water, and 47.1 g of 28 mass % ammonia water were placed in a 3-L glass reactor equipped with a stirrer, a dropping funnel, and a thermometer, and were mixed. The resulting solution was adjusted to 35° C., and 1100.0 g (7.23 mol) of tetramethoxysilane and 395.2 g of 5.4 mass % ammonia water were simultaneously added under stirring. Tetramethoxysilane and ammonia water were added dropwise over 5 h and 4 h, respectively. Even after completion of the dropwise addition, stirring was further continued for 0.2 h to perform hydrolysis, thereby providing a suspension liquid of hydrophilic spherical sol-gel silica fine particles.

After that, the pH of the suspension liquid thus prepared was adjusted to about 3.5, the reactor was then heated to 75° C., and a solution of 8.8 g of octyltriethoxysilane in 220 mL of isopropyl alcohol was added dropwise, while the contents in the reactor were stirred. After the dropwise addition, stirring was continued for 5 hours.

The stirring was followed by cooling to room temperature and filtering. The filtered material was washed with ion-exchanged water, and then dried overnight by heating at 120° C. After that, pulverization was performed with a pulverizer (produced by Hosokawa Micron Corporation) to provide the inorganic fine particles A-1.

(Manufacturing Example of Inorganic Fine Particles A-2 to A-9)

Inorganic fine particles A-2 to A-9 were obtained in the same manner as the inorganic fine particles A-1 except that the reaction temperature, the dropwise addition times of tetramethoxysilane and ammonia water, the pH of the suspension liquid of sol-gel silica fine particles, and the amount added of the surface treatment agent in the production example of the inorganic fine particles A-1 were changed.

TABLE 1

| Inorganic fine particle No. | Number-average particle diameter (D1) (nm) of primary particles | Half width (nm) |
|---|---|---|
| A-1 | 110 | 9 |
| A-2 | 105 | 24 |
| A-3 | 108 | 26 |
| A-4 | 85 | 11 |
| A-5 | 110 | 20 |
| A-6 | 80 | 7 |
| A-7 | 200 | 17 |
| A-8 | 70 | 7 |
| A-9 | 220 | 29 |

<Production of Inorganic Fine Particles B>

(Manufacturing Example of Inorganic Fine Particles B-1)

A silica starting material (fumed silica with a number-average particle diameter of primary particles of 10 nm) was charged into an autoclave equipped with a stirrer, and the silica starting material was heated to 200° C. in a fluidized state created by stirring.

The interior of the reactor was then purged with nitrogen gas, the reactor was sealed, 25 parts of hexamethyldisilazane was sprayed in the interior per 100 parts of the silica starting material, and silane compound treatment was performed in the fluidized state of silica.

The reaction was continued for 60 min and then completed. After completion of the reaction, autoclave depressurizing is implemented, cleaning was performed with a nitrogen gas flow, and excess hexamethyldisilazane and byproducts were removed from the resulting silica fine particles.

Then, 10 parts of dimethyl silicone oil (viscosity 100 $mm^2$/sec) was sprayed per 100 parts of silica fine particles, while stirring the silica fine particles in a reaction tank, and the stirring was continued for 30 min.

The temperature was then raised to 300° C. under stirring, and the stirring was further performed for 2 h.

After that, the particles were taken out and pulverized to provide inorganic fine particles B-1.

(Manufacturing Example of Inorganic Fine Particles B-2 to B-6)

Inorganic fine particles B-2 to B-6 were obtained in the same manner as in the "Manufacturing Example of Inorganic Fine Particles B-1", except that the particle diameter of the silica starting material was changed and the amount of the surface treatment agent was appropriately changed.

(Manufacturing Example of Inorganic Fine Particles B-7 and B-8)

Inorganic fine particles B-7 and B-8 were obtained in the same manner as in the "Manufacturing Example of Inorganic Fine Particles B-1", except that a titania starting material (number-average particle diameter of primary particles was 15 nm) and an alumina starting material (number-average particle diameter of primary particles was 25 nm) were used instead of the silica starting material.

TABLE 2

| Inorganic fine particle No. | Type | Number-average particle diameter (D1) (nm) of primary particles |
|---|---|---|
| B-1 | Silica | 10 |
| B-2 | Silica | 15 |
| B-3 | Silica | 7 |
| B-4 | Silica | 5 |
| B-5 | Silica | 25 |
| B-6 | Silica | 40 |
| B-7 | Titania | 15 |
| B-8 | Alumina | 25 |

(Manufacture of Binder Resin 1)

A low-molecular weight polymer (L-1) solution was obtained by loading 300 parts of xylene into a four-neck flask, raising temperature and refluxing, and dropwise adding a liquid mixture including 78 parts of styrene, 22 parts of n-butyl acrylate, and 2 parts of di-tert-butyl peroxide over 5 h.

Meanwhile, a suspension liquid was obtained by loading 180 parts of degassed water and 20 parts of a 2 mass % aqueous solution of polyvinyl alcohol into a four-neck flask, then adding a liquid mixture including 74 parts of styrene, 26 parts of n-butyl acrylate, 0.005 part of divinylbenzene, and 0.1 part of 2,2-bis(4,4-di-tert-butylperoxycyclohexyl) propane (temperature at a half-life of 10 h was 92° C.) and stirring.

After the inside of the flask was sufficiently purged with nitrogen, the polymerization was performed by raising the temperature to 85° C., followed by holding for 24 h. Then, 0.1 part of benzoyl peroxide (temperature at a half-life of 10 h was 72° C.) was further added, and the polymerization of a high-molecular weight polymer (H-1) was completed by holding for 12 h.

A styrene-acrylic type binder resin 1 (styrene acrylic resin) was obtained by loading 24 parts of the high-molecular weight polymer (H-1) into 300 parts of a homogeneous solution of the low-molecular weight polymer (L-1), sufficiently mixing under refluxing, and distilling off the organic solvent. The binder resin 1 had a glass transition temperature (Tg) of 54° C., a weight-average molecular weight (Mw) of 200,000, and a number-average molecular weight (Mn) of 10,000.

(Manufacture of Magnetic Body)

A sodium hydroxide solution was mixed with an aqueous solution of ferrous sulfate in 1.0 equivalent with respect to iron ions to prepare an aqueous solution including ferrous hydroxide. An oxidation reaction was performed at 80° C. by blowing air, while maintaining the aqueous solution at pH 9, to prepare a slurry liquid.

Then, an aqueous solution of ferrous sulfate was added to the slurry liquid in 0.9 to 1.2 equivalent with respect to the initial amount of the alkali (sodium component of sodium hydroxide). After that, the oxidation reaction was advanced, while maintaining the slurry liquid at pH 7.6 and blowing air, to obtain slurry liquid including magnetic iron oxide.

The resulting slurry liquid was filtered and washed, and water-containing slurry liquid was then taken out. The water-containing slurry liquid was filtered and sufficiently washed, followed by drying. The resulting particles were pulverized to obtain a magnetic body.

The resulting magnetic body had a number-average particle size of 0.23 μm, and a saturated magnetization and residual magnetization of 67.3 $Am^2$/kg (emu/g) and 4.5 $Am^2$/kg (emu/g) in a magnetic field of 79.6 kA/m (1000 Oe).

<Manufacturing Example of Toner Particle 1>

| | |
|---|---|
| Binder resin 1 | 100 parts |
| Magnetic body | 70 parts |
| Monoazo iron complex (T-77; produced by Hodogaya Chemical Co., Ltd.) | 2 parts |
| Low-molecular weight polyethylene wax (melting point 92° C.) | 4 parts |

The abovementioned starting materials were premixed with a Mitsui Henschel mixer (produced by Mitsui Miike Chemical Engineering Machinery, Co., Ltd.), and then melt-kneaded with a twin-screw extruder heated to 110° C. The cooled blend was coarsely pulverized with a hammer mill to obtain a coarsely pulverized material. The resulting coarsely pulverized material was mechanically pulverized using a mechanical pulverizer turbo mill (produced by Freund-Turbo Corporation; the rotor and stator surfaces were coated with a chromium carbide-containing chromium alloy plating (plating thickness 150 μm; surface hardness HV 1050)). Fines and coarse material were then removed at the same time by classifying the resulting finely pulverized material with a multi-grade classifier (Elbow-Jet classifier produced by Nittetsu Mining Co., Ltd.) that utilizes the Coanda effect, thereby providing toner particles 1.

<Manufacturing Example of Toner 1>

A total of 100.0 parts of the toner particles 1 and 4.0 parts of the inorganic fine particles A-1 were mixed in a Mitsui Henschel mixer (produced by Mitsui Miike Chemical Engineering Machinery, Co., Ltd.), and partial external addition before heat sphering was performed.

The particles subjected to the partial external addition before heat sphering were then subjected to surface treatment by using Meteo Rainbow (produced by Nippon Pneumatic Mfg. Co., Ltd.) which is an apparatus for surface treating particles by blowing hot air current. Conditions during surface treatment were as follows: starting material feed rate 2 kg/h, hot air current flow rate 700 L/min, and discharge hot air current temperature 300° C.

Then, 100.0 parts of the particles subjected to the hot sphering treatment and 1.0 part of the inorganic fine particles B-1 were mixed with the device depicted in FIG. 7 to provide Toner 1. The production conditions and physical properties of the Toner 1 are shown in Table 3 (Tables 3-1 and 3-2)and Table 4, respectively.

<Manufacturing Examples of Toners 2 to 29 and Comparative Toners 1 to 8>

Toners 2 to 29 and Comparative Toners 1 to 8 were produced in the same manner as in the "Manufacturing Example of Toner Particle 1" and "Manufacturing Example of Toner 1", except that the colorant amount (amount of the magnetic body) and conditions of heat treatment and external addition treatment were changed to those shown in Table 3 (Tables 3-1 and 3-2). The production conditions and physical properties of the Toners 2 to 29 and Comparative Toners 1 to 8 are shown in Table 3 and Table 4, respectively.

[Table 3]

TABLE 3-1

| | Toner particle | | Heat treatment 1 | | External addition treatment 1 | | | Heat treatment 2 | | External addition treatment 2 | | |
|---|---|---|---|---|---|---|---|---|---|---|---|---|
| Toner No. | Binder resin | Colorant (mass %) | Hot air current flow rate (L/min) | Discharge hot air current temperature [° C.] | Treatment device | Amount added of inorganic fine particles A (parts) | External addition condition | Hot air current flow rate (L/min) | Discharge hot air current temperature [° C.] | Treatment device | Amount added of inorganic fine particles B (parts) | External addition condition |
| 1 | 1 | Magnetic body (40) | — | — | Henschel | A-1(4.0) | 4000 rpm · 6 min | 700 | 300 | Device in FIG. 7 | B-1(1.0) | 0.30 W/g (1200 rpm) · 5 min |
| 2 | 1 | Magnetic body (40) | 700 | 300 | Device in FIG. 2 | A-1(4.0) | 4000 rpm · 6 min | — | — | Device in FIG. 7 | B-1(1.0) | 0.30 W/g (1200 rpm) · 5 min |
| 3 | 1 | Magnetic body (40) | — | — | Henschel | A-1(4.0) | 4000 rpm · 6 min | 700 | 290 | Device in FIG. 7 | B-1(1.0) | 0.30 W/g (1200 rpm) · 5 min |
| 4 | 1 | Magnetic body (40) | — | — | Henschel | A-1(4.0) | 4000 rpm · 6 min | 700 | 280 | Device in FIG. 7 | B-1(1.0) | 0.30 W/g (1200 rpm) · 5 min |
| 5 | 1 | Magnetic body (20) | — | — | Henschel | A-1(4.0) | 4000 rpm · 6 min | 700 | 300 | Device in FIG. 7 | B-1(1.0) | 0.30 W/g (1200 rpm) · 5 min |
| 6 | 1 | Magnetic body (60) | — | — | Henschel | A-1(4.0) | 4000 rpm · 6 min | 700 | 300 | Device in FIG. 7 | B-1(1.0) | 0.30 W/g (1200 rpm) · 5 min |
| 7 | 1 | Magnetic body (18) | — | — | Henschel | A-1(4.0) | 4000 rpm · 6 min | 700 | 300 | Device in FIG. 7 | B-1(1.0) | 0.30 W/g (1200 rpm) · 5 min |
| 8 | 1 | Magnetic body (63) | — | — | Henschel | A-1(4.0) | 4000 rpm · 6 min | 700 | 300 | Device in FIG. 7 | B-1(1.0) | 0.30 W/g (1200 rpm) · 5 min |
| 9 | 1 | Magnetic body (40) | — | — | Henschel | A-2(4.0) | 4000 rpm · 6 min | 700 | 300 | Device in FIG. 7 | B-1(1.0) | 0.30 W/g (1200 rpm) · 5 min |
| 10 | 1 | Magnetic body (40) | — | — | Henschel | A-3(4.0) | 4000 rpm · 6 min | 700 | 300 | Device in FIG. 7 | B-1(1.0) | 0.30 W/g (1200 rpm) · 5 min |

TABLE 3-1-continued

| | Toner particle | | Heat treatment 1 | | External addition treatment 1 | | | Heat treatment 2 | | External addition treatment 2 | | |
|---|---|---|---|---|---|---|---|---|---|---|---|---|
| Toner No. | Binder resin | Colorant (mass %) | Hot air current flow rate (L/min) | Discharge hot air current temperature [° C.] | Treatment device | Amount added of inorganic fine particles A (parts) | External addition condition | Hot air current flow rate (L/min) | Discharge hot air current temperature [° C.] | Treatment device | Amount added of inorganic fine particles B (parts) | External addition condition |
| 11 | 1 | Magnetic body (40) | 700 | 300 | Device in FIG. 2 | A-1(4.0) | 4000 rpm · 6 min | — | — | Device in FIG. 7 | B-2(1.2) | 0.30 W/g (1200 rpm) · 5 min |
| 12 | 1 | Magnetic body (40) | — | — | Henschel | A-1(4.0) | 4000 rpm · 6 min | 700 | 300 | Device in FIG. 7 | B-1(0.6) | 0.30 W/g (1200 rpm) · 5 min |
| 13 | 1 | Magnetic body (40) | — | — | Henschel | A-1(4.0) | 4000 rpm · 6 min | 700 | 300 | Device in FIG. 7 | B-1(0.5) | 0.30 W/g (1200 rpm) · 5 min |
| 14 | 1 | Magnetic body (40) | — | — | Henschel | A-1(4.0) | 4000 rpm · 6 min | 700 | 300 | Device in FIG. 7 | B-1(1.4) | 0.30 W/g (1200 rpm) · 5 min |
| 15 | 1 | Magnetic body (40) | — | — | Henschel | A-1(4.0) | 4000 rpm · 6 min | 700 | 300 | Device in FIG. 7 | B-1(1.5) | 0.30 W/g (1200 rpm) · 5 min |
| 16 | 1 | Magnetic body (40) | — | — | Henschel | A-3(2.0) | 4000 rpm · 6 min | 700 | 300 | Device in FIG. 7 | B-1(1.0) | 0.30 W/g (1200 rpm) · 5 min |
| 17 | 1 | Magnetic body (20) | — | — | Henschel | A-1(3.0) | 4000 rpm · 6 min | 700 | 300 | Device in FIG. 7 | B-1(1.0) | 0.30 W/g (1200 rpm) · 5 min |
| 18 | 1 | Magnetic body (20) | — | — | Henschel | A-3(3.0) | 4000 rpm · 6 min | 700 | 300 | Device in FIG. 7 | B-1(1.0) | 0.30 W/g (1200 rpm) · 5 min |

TABLE 3-2

| | Toner particle | | Heat treatment 1 | | External addition treatment 1 | | | Heat treatment 2 | | External addition treatment 2 | | |
|---|---|---|---|---|---|---|---|---|---|---|---|---|
| Toner No. | Binder resin | Colorant (mass %) | Hot air current flow rate (L/min) | Discharge hot air current temperature [° C.] | Treatment device | Amount added of inorganic fine particles A (parts) | External addition condition | Hot air current flow rate (L/min) | Discharge hot air current temperature [° C.] | Treatment device | Amount added of inorganic fine particles B (parts) | External addition condition |
| 19 | 1 | Magnetic body (40) | 700 | 300 | Device in FIG. 2 | A-1(4.0) | 4000 rpm · 6 min | — | — | Device in FIG. 7 | B-3(1.0) | 0.30 W/g (1200 rpm) · 5 min |
| 20 | 1 | Magnetic body (40) | 700 | 300 | Device in FIG. 2 | A-4(3.2) | 4000 rpm · 6 min | — | — | Device in FIG. 7 | B-1(1.0) | 0.30 W/g (1200 rpm) · 5 min |
| 21 | 1 | Magnetic body (40) | 700 | 300 | Device in FIG. 2 | A-5(4.0) | 4000 rpm · 6 min | — | — | Device in FIG. 7 | B-1(1.0) | 0.30 W/g (1200 rpm) · 5 min |
| 22 | 1 | Magnetic body (40) | 700 | 300 | Device in FIG. 2 | A-5(4.0) | 4000 rpm · 6 min | — | — | Device in FIG. 7 | B-1(0.5), B-2(0.5) | 0.30 W/g (1200 rpm) · 5 min |
| 23 | 1 | Magnetic body (40) | 700 | 300 | Device in FIG. 2 | A-5(4.0) | 4000 rpm · 6 min | — | — | Device in FIG. 7 | B-1(0.5), B-7(1.0) | 0.30 W/g (1200 rpm) · 5 min |
| 24 | 1 | Magnetic body (40) | 700 | 300 | Device in FIG. 2 | A-5(4.0) | 4000 rpm · 6 min | — | — | Device in FIG. 7 | B-1(0.5), B-8(1.0) | 0.30 W/g (1200 rpm) · 5 min |
| 25 | 1 | Magnetic body (40) | — | — | Henschel | A-1(4.0) | 4000 rpm · 6 min | 700 | 300 | Device in FIG. 7 | B-4(0.7) | 0.30 W/g (1200 rpm) · 5 min |
| 26 | 1 | Magnetic body (40) | — | — | Henschel | A-1(4.0) | 4000 rpm · 6 min | 700 | 300 | Device in FIG. 7 | B-5(1.4) | 0.30 W/g (1200 rpm) · 5 min |

TABLE 3-2-continued

| | Toner particle | | Heat treatment 1 | | External addition treatment 1 | | | Heat treatment 2 | | External addition treatment 2 | | |
|---|---|---|---|---|---|---|---|---|---|---|---|---|
| Toner No. | Binder resin | Colorant (mass %) | Hot air current flow rate (L/min) | Discharge hot air current temperature [° C.] | Treatment device | Amount added of inorganic fine particles A (parts) | External addition condition | Hot air current flow rate (L/min) | Discharge hot air current temperature [° C.] | Treatment device | Amount added of inorganic fine particles B (parts) | External addition condition |
| 27 | 1 | Magnetic body (40) | — | — | Henschel | A-6(3.0) | 4000 rpm · 6 min | 700 | 300 | Device in FIG. 7 | B-1(1.0) | 0.30 W/g (1200 rpm) · 5 min |
| 28 | 1 | Magnetic body (40) | — | — | Henschel | A-7(6.0) | 4000 rpm · 6 min | 700 | 320 | Device in FIG. 7 | B-1(1.0) | 0.30 W/g (1200 rpm) · 5 min |
| 29 | 1 | Magnetic body (40) | — | — | Henschel | A-1(4.0) | 4000 rpm · 6 min | 700 | 300 | Device in FIG. 7 | B-1(1.0) | 0.30 W/g (1200 rpm) · 5 min |
| Comparative 1 | 1 | Magnetic body (40) | — | — | Henschel | A-3(4.0) | 4000 rpm · 6 min | 700 | 300 | Device in FIG. 7 | B-1(1.0) | 0.30 W/g (1200 rpm) · 5 min |
| Comparative 2 | 1 | Magnetic body (40) | — | — | Henschel | A-8(3.0) | 4000 rpm · 6 min | 700 | 300 | Device in FIG. 7 | B-1(1.0) | 0.30 W/g (1200 rpm) · 5 min |
| Comparative 3 | 1 | Magnetic body (40) | — | — | Henschel | A-9(6.0) | 4000 rpm · 6 min | 700 | 320 | Device in FIG. 7 | B-1(1.0) | 0.30 W/g (1200 rpm) · 5 min |
| Comparative 4 | 1 | Magnetic body (40) | 700 | 300 | Henschel | A-3(4.0) | 4000 rpm · 6 min | — | — | Device in FIG. 7 | B-6(1.5) | 0.30 W/g (1200 rpm) · 5 min |
| Comparative 5 | 1 | Magnetic body (20) | — | — | Henschel | A-7(6.0) | 4000 rpm · 6 min | 700 | 300 | Device in FIG. 7 | B-1(1.0) | 0.30 W/g (1200 rpm) · 5 min |
| Comparative 6 | 1 | Magnetic body (40) | 700 | 300 | Henschel | A-3(4.0) | 4000 rpm · 6 min | — | — | Device in FIG. 7 | B-1(0.8) | 0.30 W/g (1200 rpm) · 5 min |
| Comparative 7 | 1 | Magnetic body (40) | 700 | 300 | — | — | — | — | — | Device in FIG. 7 | B-1(1.0) | 0.30 W/g (1200 rpm) · 5 min |
| Comparative 8 | 1 | Magnetic body (40) | — | — | Henschel | A-7(6.0) | 4000 rpm · 6 min | — | — | Device in FIG. 7 | B-1(1.0) | 0.30 W/g (1200 rpm) · 5 min |

TABLE 4

| Toner No. | Weight-average particle diameter (D4) (μm) | Average circularity | A | B | C | D | E | F |
|---|---|---|---|---|---|---|---|---|
| 1 | 8.0 | 0.971 | 110 | 9 | 99 | 70.1 | 13.0 | 0.35 |
| 2 | 8.0 | 0.970 | 110 | 9 | 86 | 69.0 | 18.8 | 0.48 |
| 3 | 8.1 | 0.961 | 110 | 9 | 97 | 68.5 | 20.0 | 0.42 |
| 4 | 8.1 | 0.955 | 110 | 9 | 96 | 67.4 | 22.0 | 0.40 |
| 5 | 8.0 | 0.967 | 110 | 9 | 99 | 70.0 | 20.0 | 0.55 |
| 6 | 8.0 | 0.968 | 110 | 9 | 94 | 68.3 | 19.0 | 0.37 |
| 7 | 8.1 | 0.968 | 110 | 9 | 99 | 69.4 | 20.0 | 0.56 |
| 8 | 8.0 | 0.969 | 110 | 9 | 94 | 69.0 | 19.0 | 0.37 |
| 9 | 8.0 | 0.970 | 105 | 24 | 94 | 67.1 | 23.0 | 0.51 |
| 10 | 8.1 | 0.970 | 108 | 26 | 94 | 66.8 | 24.0 | 0.52 |
| 11 | 7.9 | 0.969 | 110 | 9 | 85 | 68.0 | 25.0 | 0.80 |
| 12 | 8.0 | 0.970 | 110 | 9 | 99 | 46.1 | 26.0 | 0.54 |
| 13 | 8.1 | 0.970 | 110 | 9 | 99 | 43.1 | 27.0 | 0.55 |
| 14 | 8.0 | 0.970 | 110 | 9 | 98 | 89.0 | 12.0 | 0.31 |
| 15 | 8.0 | 0.970 | 110 | 9 | 97 | 93.1 | 11.0 | 0.32 |
| 16 | 8.1 | 0.969 | 108 | 26 | 97 | 66.2 | 29.0 | 0.55 |
| 17 | 7.9 | 0.968 | 110 | 9 | 99 | 69.4 | 25.0 | 0.59 |
| 18 | 8.0 | 0.969 | 108 | 26 | 97 | 66.2 | 30.0 | 0.60 |
| 19 | 8.1 | 0.969 | 110 | 9 | 89 | 79.4 | 17.0 | 0.60 |
| 20 | 8.0 | 0.969 | 85 | 11 | 87 | 65.1 | 19.8 | 0.65 |
| 21 | 7.9 | 0.968 | 110 | 20 | 83 | 68.2 | 25.0 | 0.88 |
| 22 | 8.0 | 0.968 | 110 | 20 | 84 | 69.1 | 30.0 | 0.89 |
| 23 | 7.9 | 0.970 | 110 | 20 | 87 | 71.0 | 19.4 | 0.70 |

TABLE 4-continued

| Toner No. | Weight-average particle diameter (D4) (μm) | Average circularity | A | B | C | D | E | F |
|---|---|---|---|---|---|---|---|---|
| 24 | 8.0 | 0.970 | 110 | 20 | 86 | 70.5 | 19.6 | 0.67 |
| 25 | 7.9 | 0.970 | 110 | 9 | 99 | 72.0 | 16.0 | 0.42 |
| 26 | 8.0 | 0.970 | 110 | 9 | 99 | 68.2 | 19.0 | 0.35 |
| 27 | 8.0 | 0.968 | 80 | 7 | 99 | 70.1 | 16.0 | 0.51 |
| 28 | 7.9 | 0.970 | 200 | 17 | 96 | 69.7 | 23.0 | 0.42 |
| 29 | 8.1 | 0.967 | 110 | 9 | 76 | 67.0 | 27.5 | 0.86 |
| Comparative 1 | 8.0 | 0.967 | 108 | 26 | 74 | 65.1 | 30.0 | 0.90 |
| Comparative 2 | 7.9 | 0.968 | 70 | 7 | 99 | 70.1 | 16.0 | 0.51 |
| Comparative 3 | 8.0 | 0.967 | 220 | 29 | 96 | 64.1 | 29.0 | 0.71 |
| Comparative 4 | 8.0 | 0.967 | 108 | 26 | 82 | 55.0 | 29.6 | 0.62 |
| Comparative 5 | 8.1 | 0.968 | 200 | 17 | 96 | 69.0 | 33.0 | 0.69 |
| Comparative 6 | 7.9 | 0.968 | 108 | 26 | 81 | 68.1 | 25.0 | 0.95 |

TABLE 4-continued

| Toner No. | Weight-average particle diameter (D4) (μm) | Average circularity | A | B | C | D | E | F |
|---|---|---|---|---|---|---|---|---|
| Comparative 7 | 8.0 | 0.968 | — | — | 96 | 70.1 | 29.0 | 1.10 |
| Comparative 8 | 8.1 | 0.935 | 200 | 17 | 71 | 53.2 | 38.0 | 1.20 |

A, B, C, D, E, and F in Table 4 are described hereinbelow.

A: number-average particle diameter (D1) [nm] of the primary particles of the inorganic fine particles A present on the toner particle surface.

B: half width [nm] of the maximum peak in the particle size distribution of the primary particles of the inorganic fine particles A.

C: total fixing ratio [%] of the inorganic fine particles A and inorganic fine particles B to the toner particle.

D: ratio [%] of coverage of the toner particle surface with the inorganic fine particles B.

E: inter-particle force Fp (A) (nN).

F: value calculated by (Fp(B) − Fp(A))/Fp(A).

Evaluation methods used in various evaluations performed in the Examples and Comparative Examples and determination criteria thereof are described hereinbelow.

A Canon printer LBP3100 was modified and used for image output evaluation. The modification involved using the toner carrying member 1 and bringing the toner carrying member 1 into contact with the electrostatic latent image bearing member. Further, the cleaning blade was removed and the contact pressure was adjusted such that the width of the contact region of the toner carrying member and the electrostatic latent image bearing member was 1.0 mm.

The printer thus modified was loaded with 100 g of toner and used as an evaluation apparatus.

Further, the evaluation was performed under a low-temperature and low-humidity environment (15° C., 10% RH).

Meanwhile, in the evaluation apparatus, a DC voltage was applied to the charging member such that an electric potential on the electrostatic latent image bearing member was −800 V, and a DC voltage of −300 V was applied to the toner carrying member.

Furthermore, in each evaluation, the following evaluation was initially performed (initial evaluation), then a horizontal line image such that had a print percentage of 2% was printed on 3000 sheets in an intermittent 2-sheet paper passage mode, and the following evaluation was performed again (evaluation after 3000 sheets). Transfer printing paper (produced by XEROX Corporation; weight 75 g/cm$^2$) was used for the evaluation.

[Image Density]

For image density, a solid black image was formed and the density of the solid black image was measured with a Macbeth reflection densitometer (produced by Macbeth Corporation).

A: 1.50 or more

B: from 1.40 to 1.49

C: from 1.30 to 1.39

D: 1.29 or less

[Fogging on Electrostatic Latent Image Bearing Member]

Fogging was measured using REFLECTOMETER MODEL TC-6DS produced by Tokyo Denshoku Co., Ltd. As a filter, a green filter was used.

Fogging on the electrostatic latent image bearing member was calculated by taping the electrostatic latent image bearing member with a Mylar tape immediately after the solid black image output and before the solid white image transfer and subtracting the reflectance (%) of paper onto which the Mylar tape has been attached from the reflectance of a Mylar tape attached onto unused paper.

A: 5% or less

B: from 6% to 10%

C: from 11% to 15%

D: 16% or more

[Development Ghost]

A plurality of 10 mm×10 mm solid black images was formed on the front half of transfer paper and a 2-dot-3-space half-tone image was formed on the rear half. The degree of appearance of traces of the solid black image on the half-tone image was visually determined.

A: no ghost appeared

B: very light ghost appeared

C: light ghost appeared

D: significant ghost appeared

[Image Density Non-Uniformity]

A half-tone image was printed out and the image uniformity (image density non-uniformity) was evaluated. The density was measured using a Macbeth reflection densitometer (produced by Macbeth Corporation).

A: difference in density between maximum reflection density and minimum reflection density: 0.02 or less B: difference in density between maximum reflection density and minimum reflection density: from 0.03 to 0.05

C: difference in density between maximum reflection density and minimum reflection density: from 0.06 to 0.10

D: difference in density between maximum reflection density and minimum reflection density: 0.11 or more

[White Spots]

White spots were evaluated by outputting a solid black image and visually observing losses (white spots) in black regions.

A: number of white spots is 0

B: number of white spots is from 1 to 2

C: number of white spots is from 3 to 5

D: number of white spots is 6 or more

Example 1

The Toner 1 was evaluated using the abovementioned evaluation methods.

The results demonstrated that an image which was free of image defects and had good image density could be obtained under a low-temperature and low-humidity environment even when no cleaning means was provided. The evaluation results are shown in Table 5.

Examples 2 to 29

The toner was changed as indicated in Table 5 and the evaluation was performed in the same manner as in Example 1. The results demonstrated that an image which was free of image defects and had good image density could be obtained under a low-temperature and low-humidity environment. The evaluation results are shown in Table 5.

Comparative Examples 1 to 8

The toner was changed as indicated in Table 5 and the evaluation was performed in the same manner as in Example 1. The results demonstrated that image defects appeared under a low-temperature and low-humidity environment. The evaluation results are shown in Table 5.

TABLE 5

| | | Low-temperature and low-humidity environment (15° C., 10% RH) | | | | | | | | | | | | | | |
|---|---|---|---|---|---|---|---|---|---|---|---|---|---|---|---|---|
| | | Image density | | | | Fogging | | | | Development ghost | | Image density non-uniformity | | | | White spots |
| | Toner No. | Initial | | After 3000 prints | | Initial [%] | | After 3000 prints [%] | | Initial | After 3000 prints | Initial | | After 3000 prints | | After 3000 prints |
| Example 1 | 1 | 1.56 | A | 1.54 | A | 1 | A | 2 | A | A | A | 0.01 | A | 0.01 | A | A |
| Example 2 | 2 | 1.55 | A | 1.53 | A | 2 | A | 5 | A | A | B | 0.01 | A | 0.03 | B | B |
| Example 3 | 3 | 1.55 | A | 1.51 | A | 2 | A | 6 | B | A | B | 0.02 | A | 0.03 | B | A |
| Example 4 | 4 | 1.54 | A | 1.49 | B | 3 | A | 5 | A | B | B | 0.02 | A | 0.04 | B | A |
| Example 5 | 5 | 1.41 | B | 1.35 | C | 4 | A | 6 | B | B | C | 0.01 | A | 0.03 | B | A |
| Example 6 | 6 | 1.58 | A | 1.54 | A | 4 | A | 7 | B | A | B | 0.02 | A | 0.02 | A | A |
| Example 7 | 7 | 1.39 | C | 1.33 | C | 3 | A | 6 | B | B | C | 0.01 | A | 0.03 | B | A |
| Example 8 | 8 | 1.58 | A | 1.55 | A | 4 | A | 8 | B | A | B | 0.02 | A | 0.04 | B | A |
| Example 9 | 9 | 1.55 | A | 1.51 | A | 5 | A | 8 | B | A | B | 0.02 | A | 0.06 | C | A |
| Example 10 | 10 | 1.54 | A | 1.48 | B | 6 | B | 9 | B | A | B | 0.03 | B | 0.06 | C | A |
| Example 11 | 11 | 1.53 | A | 1.41 | B | 2 | A | 10 | B | B | C | 0.03 | B | 0.09 | C | B |
| Example 12 | 12 | 1.51 | A | 1.39 | C | 3 | A | 11 | C | B | B | 0.05 | B | 0.07 | C | A |
| Example 13 | 13 | 1.48 | B | 1.35 | C | 4 | A | 12 | C | B | C | 0.05 | B | 0.07 | C | A |
| Example 14 | 14 | 1.55 | A | 1.53 | A | 2 | A | 4 | A | B | C | 0.01 | A | 0.02 | A | A |
| Example 15 | 15 | 1.55 | A | 1.53 | A | 2 | A | 4 | A | B | B | 0.01 | A | 0.02 | A | A |
| Example 16 | 16 | 1.54 | A | 1.41 | B | 8 | B | 12 | C | B | B | 0.03 | B | 0.07 | C | A |
| Example 17 | 17 | 1.41 | B | 1.32 | C | 6 | B | 13 | C | B | B | 0.04 | B | 0.08 | C | A |
| Example 18 | 18 | 1.40 | B | 1.31 | C | 7 | B | 14 | C | B | C | 0.05 | B | 0.09 | C | A |
| Example 19 | 19 | 1.53 | A | 1.41 | B | 4 | A | 12 | C | A | B | 0.02 | A | 0.05 | B | A |
| Example 20 | 20 | 1.53 | A | 1.39 | C | 5 | A | 13 | C | A | C | 0.04 | B | 0.08 | C | A |
| Example 21 | 21 | 1.52 | A | 1.37 | C | 8 | B | 14 | C | B | C | 0.06 | C | 0.09 | C | B |
| Example 22 | 22 | 1.51 | A | 1.34 | C | 9 | B | 15 | C | B | C | 0.06 | C | 0.10 | C | B |
| Example 23 | 23 | 1.44 | B | 1.39 | C | 4 | A | 8 | B | A | B | 0.03 | B | 0.05 | B | A |
| Example 24 | 24 | 1.45 | B | 1.38 | C | 5 | A | 9 | B | A | B | 0.03 | B | 0.05 | B | B |
| Example 25 | 25 | 1.54 | A | 1.37 | C | 2 | A | 10 | B | A | B | 0.01 | A | 0.07 | C | A |
| Example 26 | 26 | 1.42 | B | 1.40 | B | 6 | B | 11 | C | A | B | 0.02 | A | 0.06 | C | A |
| Example 27 | 27 | 1.53 | A | 1.39 | C | 2 | A | 12 | C | A | C | 0.01 | A | 0.04 | B | A |
| Example 28 | 28 | 1.42 | B | 1.37 | C | 8 | B | 13 | C | B | B | 0.04 | B | 0.05 | B | A |
| Example 29 | 29 | 1.54 | A | 1.32 | C | 10 | B | 15 | C | B | C | 0.06 | C | 0.10 | C | C |
| Comparative Example1 | Comparative 1 | 1.50 | A | 1.29 | D | 11 | C | 17 | D | B | D | 0.07 | C | 0.12 | D | D |
| Comparative Example2 | Comparative 2 | 1.49 | B | 1.35 | C | 5 | A | 16 | D | A | C | 0.03 | B | 0.07 | C | A |
| Comparative Example3 | Comparative 3 | 1.39 | C | 1.35 | C | 14 | C | 18 | D | B | C | 0.04 | B | 0.10 | C | A |
| Comparative Example4 | Comparative 4 | 1.38 | C | 1.32 | C | 9 | B | 16 | D | C | C | 0.05 | B | 0.11 | D | C |
| Comparative Example5 | Comparative 5 | 1.29 | D | 1.24 | D | 9 | B | 17 | D | C | C | 0.08 | C | 0.12 | D | A |
| Comparative Example6 | Comparative 6 | 1.36 | C | 1.27 | D | 10 | B | 20 | D | B | D | 0.07 | C | 0.14 | D | C |
| Comparative Example7 | Comparative 7 | 1.42 | B | 1.28 | D | 11 | C | 24 | D | C | D | 0.09 | C | 0.20 | D | A |
| Comparative Example8 | Comparative 8 | 1.37 | C | 1.30 | C | 12 | C | 26 | D | C | D | 0.08 | C | 0.22 | D | D |

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2016-014520, filed Jan. 28, 2016, which is hereby incorporated by reference herein in its entirety.

What is claimed is:

1. A toner comprising: a toner particle containing a binder resin and a colorant, and an inorganic fine particle A and an inorganic fine particle B present on a surface of the toner particle, wherein the inorganic fine particle A is a silica fine particle having a number-average particle diameter (D1) of primary particles of not less than 80 nm and not more than 200 nm;

the inorganic fine particle B has a number-average particle diameter (D1) of primary particles of not less than 5 nm and not more than 25 nm, and is at least one fine particle which is selected from a group consisting of a silica fine particle, a titanium oxide fine particle, and an alumina fine particle;

when a fixing ratio of the inorganic fine particle A to the toner particle is represented by a fixing ratio A and a fixing ratio of the inorganic fine particle B to the toner particle is represented by a fixing ratio B, a sum of the fixing ratio A and the fixing ratio B is 75% or more, where an inter-particle force measured after a load of 78.5 N is applied to the toner is Fp(A) and an inter-particle force measured after a load of 157.0 N is applied to the toner is Fp(B), the Fp(A) and the Fp(B) satisfy the following Formulas (1) and (2):

$$Fp(A) \leq 30.0 \text{ nN, and} \quad \text{Formula (1):}$$

$$(Fp(B)-Fp(A))/Fp(A) \leq 0.90. \quad \text{Formula (2):}$$

2. The toner according to claim 1, wherein the inorganic fine particle A has a half width of a maximum peak, in a particle size distribution of primary particles, of 25 nm or less.

3. The toner according to claim 1, wherein a ratio of coverage of the surface of the toner particle with the inorganic fine particle B is from 45.0% to 90.0%.

4. The toner according to claim 1, wherein the colorant includes a magnetic body; and a content of the magnetic body in the toner is from 20 mass % to 60 mass %.

5. The toner according to claim 1, wherein an average circularity of the toner is 0.960 or more.

6. An image forming apparatus comprising:

an electrostatic latent image bearing member;

a contact type charging roller that electrically charges the electrostatic latent image bearing member;

image exposure means for forming an electrostatic latent image on a surface of the electrically charged electrostatic latent image bearing member;

development means for developing the electrostatic latent image with a toner and forming a toner image;

transfer means for transferring the toner image onto a transfer material via an intermediate transfer body or without the intermediate transfer body; and fixing means for fixing the toner image, which has been transferred onto the transfer material, to the transfer material, the image forming apparatus including no cleaning means for removing residual toner in a region downstream of the transfer means and upstream of the contact type charging roller, and the residual toner being recovered by the development means, wherein the toner is the toner according to claim 1.

7. An image forming method comprising:

a charging step of charging a surface of an electrostatic latent image bearing member by using a contact type charging roller;

an electrostatic latent image forming step of exposing the electrically charged surface of the electrostatic latent image bearing member and forming an electrostatic latent image;

a development step of developing the electrostatic latent image with a toner and forming a toner image;

a transfer step of transferring the toner image onto a transfer material via an intermediate transfer body or without the intermediate transfer body; and a fixing step of fixing the toner image, which has been transferred onto the transfer material, to the transfer material, the image forming method including no cleaning step of removing residual toner between the transfer step and the charging step, and the residual toner being recovered by development means, wherein the toner comprising: a toner particle containing a binder resin and a colorant, and an inorganic fine particle A and an inorganic fine particle B present on a surface of the toner particle, wherein the inorganic fine particle A is a silica fine particle having a number-average particle diameter (D1) of primary particles of not less than 80 nm and not more than 200 nm;

the inorganic fine particle B has a number-average particle diameter (D1) of primary particles of not less than 5 nm and not more than 25 nm, and is at least one fine particle which is selected from a group consisting of a silica fine particle, a titanium oxide fine particle, and an alumina fine particle;

when a fixing ratio of the inorganic fine particle A to the toner particle is represented by a fixing ratio A and a fixing ratio of the inorganic fine particle B to the toner particle is represented by a fixing ratio B, a sum of the fixing ratio A and the fixing ratio B is 75% or more, where an inter-particle force measured after a load of 78.5 N is applied to the toner is Fp(A) and an inter-particle force measured after a load of 157.0 N is applied to the toner is Fp(B), the Fp(A) and the Fp(B) satisfy the following Formulas (1) and (2):

$$Fp(A) \leq 30.0 \text{ nN, and} \quad \text{Formula (1):}$$

$$(Fp(B)-Fp(A))/Fp(A) \leq 0.90. \quad \text{Formula (2):}$$

* * * * *